US009925793B2

(12) United States Patent
Kuribayashi

(10) Patent No.: US 9,925,793 B2
(45) Date of Patent: Mar. 27, 2018

(54) PRESSURE ADJUSTING DEVICE FOR INKJET DEVICE

(71) Applicant: TOSHIBA TEC KABUSHIKI KAISHA, Tokyo (JP)

(72) Inventor: Yasushi Kuribayashi, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/684,872

(22) Filed: Aug. 23, 2017

(65) Prior Publication Data

US 2017/0348976 A1 Dec. 7, 2017

Related U.S. Application Data

(62) Division of application No. 15/163,020, filed on May 24, 2016, now Pat. No. 9,776,421.

(30) Foreign Application Priority Data

Jun. 4, 2015 (JP) ..... 2015-113617

(51) Int. Cl.

| | |
|---|---|
| ***B41J 2/18*** | (2006.01) |
| ***B41J 2/14*** | (2006.01) |
| ***B41J 2/175*** | (2006.01) |
| *B41J 2/165* | (2006.01) |

(52) U.S. Cl.

CPC ..... *B41J 2/18* (2013.01); *B41J 2/14233* (2013.01); *B41J 2/175* (2013.01); *B41J 2/17509* (2013.01); *B41J 2/17513* (2013.01); *B41J 2/17553* (2013.01); *B41J 2/1652* (2013.01); *B41J 2/16508* (2013.01); *B41J 2/16535* (2013.01); *B41J 2202/12* (2013.01)

(58) Field of Classification Search

CPC .... B41J 2/175; B41J 2/17509; B41J 2/17513; B41J 2/17553; B41J 2/18; B41J 2/17596; B41J 2002/05; B41J 2002/1222

See application file for complete search history.

(56) References Cited

U.S. PATENT DOCUMENTS

| | | | |
|---|---|---|---|
| 3,970,388 | A | 7/1976 | Hacker |
| 4,343,596 | A | 8/1982 | Shimazawa et al. |
| 2010/0182809 | A1 | 7/2010 | Cullinane et al. |
| 2016/0067982 | A1 | 3/2016 | Kuribayashi |
| 2016/0067983 | A1 | 3/2016 | Kuribayashi |

FOREIGN PATENT DOCUMENTS

| | | |
|---|---|---|
| JP | 2009-115254 | 5/2009 |

*Primary Examiner* — Geoffrey Mruk
*Assistant Examiner* — Scott A Richmond
(74) *Attorney, Agent, or Firm* — Patterson & Sheridan, LLP

(57) ABSTRACT

A pressure adjusting device includes a housing with a cylinder. A piston moves within the cylinder in an axial direction. A pulse motor is fixed to the housing. A switch provided on a surface of the cylinder is actuated by movement of the piston in the cylinder in the axial direction. The switch includes a fixed contact point and a moveable contact point. The piston presses the movable contact point to abut against the fixed contact point when the piston moves from a position other than the initial position to the initial position so that the movable contact point electrically contacts the fixed contact point.

16 Claims, 24 Drawing Sheets

PRESSURE ADJUSTING DEVICE FOR INKJET DEVICE

CROSS-REFERENCE TO RELATED APPLICATIONS

This application is a division of U.S. patent application Ser. No. 15/163,020, filed on May 24, 2016, which is based upon and claims the benefit of priority from Japanese Patent Application No. 2015-113617, filed on Jun. 4, 2015, the entire contents of each of which are incorporated herein by reference.

FIELD

Embodiments described herein relate generally to a pressure adjusting device for use in an inkjet device.

BACKGROUND

Generally, as an example of a pressure adjusting device incorporated into a liquid discharge apparatus, a device that maintains a pressure of a meniscus of an ink jet head in a proper range is known. In such a pressure adjusting device, for example, a pressure of the liquid is adjusted by a combination of a volume change of air within a cylinder, for example, due to movement of a piston arranged within the cylinder and a switching operation of an opening and closing member that opens and closes a flow path of the liquid.

In such a device, the piston arranged within the cylinder is moved in an axial direction and an opening and closing valve and the like are driven to be opened and closed according to a moving position of the piston in the axial direction. Therefore, the moving position of the piston in the axial direction is accurately controlled when moving the piston in the axial direction by, for example, a pulse motor.

In addition, there is a fluid shutoff device including a stepping motor as a driving source and a shutoff valve that drives a valve body and performs opening and closing of a flow path by converting a rotational movement of the stepping motor into a linear movement. In the device, a magnetic reed switch is in a state of being turned ON and thereby an opening and closing state of the shutoff valve is detected as an electric signal.

In a case where the moving position of the piston in the axial direction is accurately controlled, it is necessary to accurately detect an origin point position of a rotation shaft of the pulse motor. Since there is a variation in sensitivity in the reed switch, the reed switch can be used for detecting opening and closing, but it is difficult to use the reed switch to accurately position a position of the shutoff valve. Therefore, as a unit that detects the origin point position of the rotation shaft of the pulse motor, it is difficult to use the magnetic reed switch.

In addition, as a unit that detects the origin point position of the rotation shaft of the pulse motor, it is also considered to use a mechanical switch in which two electrical contacts are arranged to be contactable and separable and which detect an electric signal by contact between the two electrical contacts. However, when the moving position of the piston within the cylinder is detected by the mechanical switch, it is necessary to use an electrical wiring structure for wiring signal lines and the like. Then, when the mechanical switch is arranged within the cylinder on a closed area side, it is necessary to seal the signal lines and the like, whereby the structure is complicated and increased in size. Thus, while it is desirable to use the mechanical switch in an area within the cylinder, which is not the closed area, since there is the pulse motor on a side which does not need to be sealed, a space-saving switch is required.

DETAILED DESCRIPTION

Figure 1:
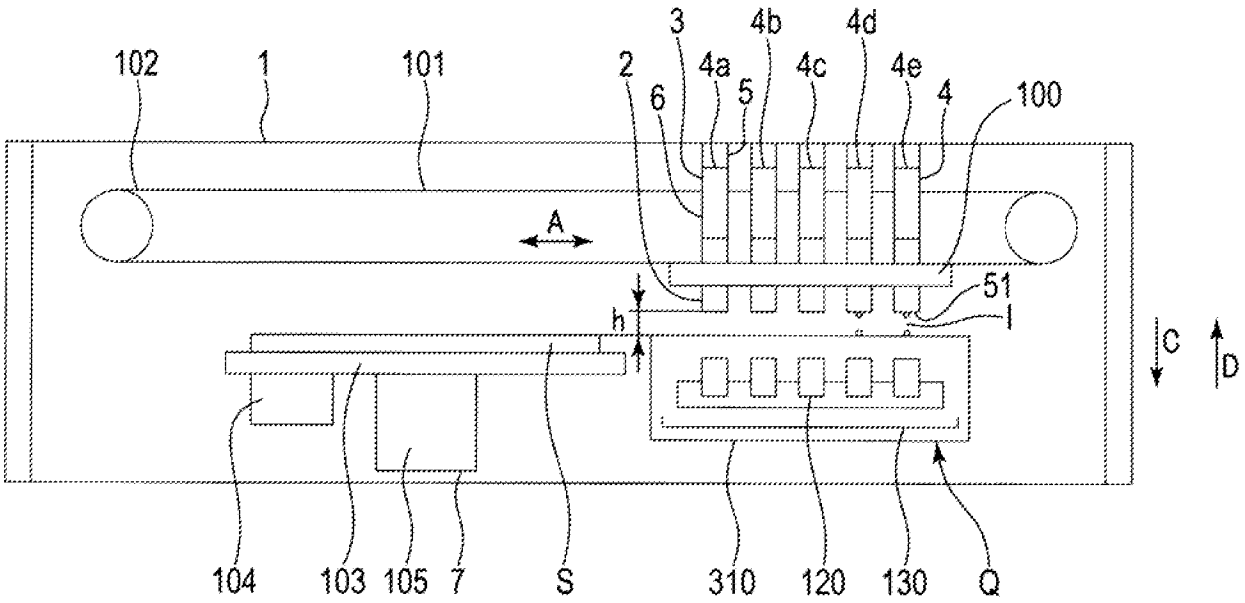
FIG. 1 is a side view of an ink jet printing apparatus according to a first embodiment.

According to an embodiment, there is provided a pressure adjusting device in which an origin point position of a rotation shaft of a pulse motor can be accurately detected and a switch can be used.

A pressure adjusting device includes a housing with a cylinder. A piston moves within the cylinder in an axial direction. A pulse motor is fixed to the housing and selectively moves the piston. A switch provided on a surface of the cylinder is actuated by movement of the piston in the cylinder in the axial direction. The switch includes a fixed contact point and a moveable contact point. The piston presses the movable contact point to abut against the contact point of the first contact member when the piston moves from a position other than the initial position to the initial position so that the movable contact point electrically contacts the contact point of the first contact member.

First Embodiment

Hereinafter, an ink jet printing apparatus 1 into which a pressure adjusting device according to a first embodiment is incorporated will be described with reference to FIGS. 1 to 23. For description in each figure, appropriate configurations are reduced, enlarged, or omitted. Moreover, the same reference numeral is given to the same structure or a similar structure.

Figure 2:
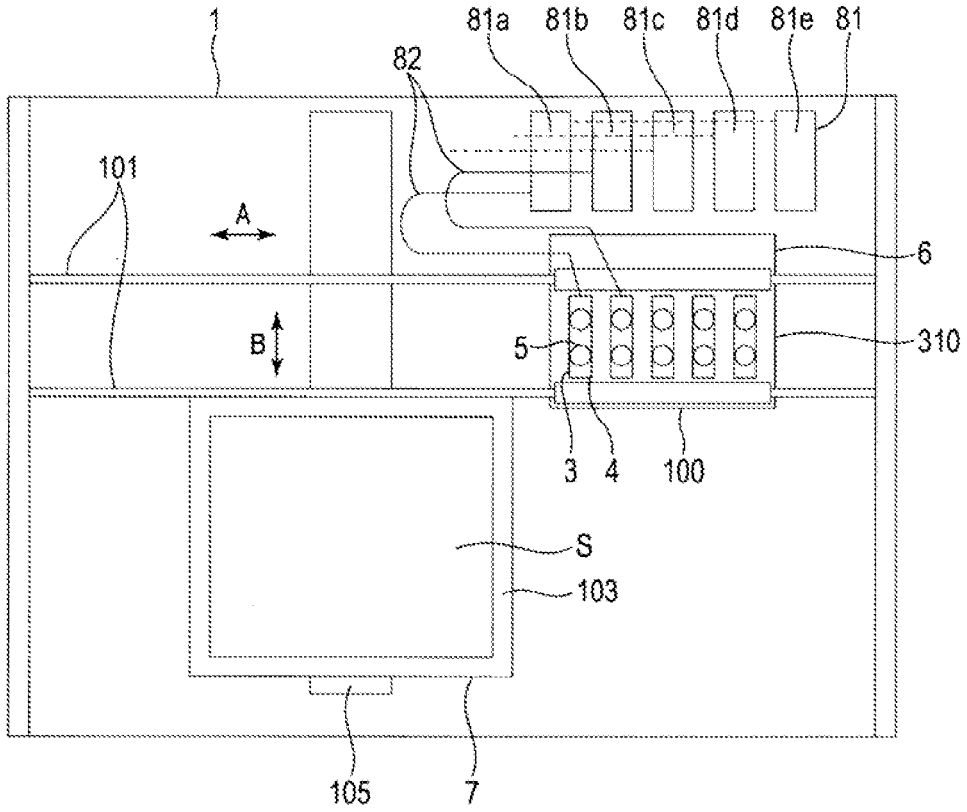
FIG. 2 is a top view of the ink jet printing apparatus.

FIG. 1 is a side view of the ink jet printing apparatus 1 and FIG. 2 is a plan view of the ink jet printing apparatus 1. As illustrated in FIGS. 1 and 2, the inkjet printing apparatus 1 includes an image forming unit 6, a recording medium moving unit 7 that is a transport unit, and a maintenance unit 310.

The image forming unit 6 includes an ink jet printing unit 4, a carriage 100 that supports the ink jet printing unit 4, a transport belt 101 that causes the carriage 100 to reciprocate in an arrow direction A, and a carriage motor 102 that drives the transport belt 101.

The ink jet printing unit 4 includes an inkjet head 2 that is a liquid ejecting unit, an ink circulating device 3 that is a circulating unit, and a pressure adjusting unit (pressure adjusting device) 5.

The ink circulating device 3 is present above the ink jet head 2 and is integrally formed with the ink jet head 2. The ink jet printing unit 4 ejects ink onto a recording medium S and forms a desired image.

The ink jet printing unit 4 includes, for example, ink jet printing units 4*a*, 4*b*, 4*c*, 4*d*, and 4*e* respectively ejecting cyan ink, magenta ink, yellow ink, black ink, and white ink. The colors or characteristics of ink within used by each of the ink jet printing units 4*a*, 4*b*, 4*c*, 4*d*, and 4*e* is not limited. For example, the ink jet printing unit 4*e* may eject a transparent glossy ink, a special ink, and the like for coloring when being irradiated with infrared or ultraviolet light instead of the white ink. The inkjet printing units 4*a*, 4*b*, 4*c*, 4*d*, and 4*e* use respectively different inks, but have the same configuration. Accordingly, description will be given with reference to common reference numerals.

A width of the ink jet printing unit 4 is narrowed by stacking the ink circulating device 3 above the ink jet head 2. Therefore, it is possible to narrow a width of the carriage 100 supporting a plurality of ink jet printing units 4*a* to 4*e* in parallel. The image forming unit 6 can reduce a transport distance of the carriage 100, reduce the size of the ink jet printing apparatus 1, and increase a printing speed by narrowing the width of the carriage 100.

The image forming unit 6 includes an ink cartridge 81 for replenishing new ink in the ink circulating device 3. The ink cartridges 81 (81*a*, 81*b*, 81*c*, 81*d*, and 81*e*) are respectively hold cyan ink, magenta ink, yellow ink, black ink, and white ink. The ink cartridges 81*a*, 81*b*, 81*c*, 81*d*, and 81*e* respectively have different inks to be held, but have the same configuration. Accordingly, description will be given with reference to common reference numerals. The ink cartridge 81 communicates with the ink circulating device 3 of the ink jet printing unit 4 via a tube 82. The ink cartridge 81 is arranged relatively downward from the ink circulating device 3 in a direction of gravity.

The recording medium moving unit 7 includes a table 103 for adsorbing and fixing the recording medium S. The table 103 is mounted on a slide rail 105 and reciprocates in an arrow direction B. The table 103 fixes the recording medium S by adsorbing the recording medium S from holes having small diameters of an upper surface by causing an inside thereof to be a negative pressure by a pump 104. A distance h between a nozzle plate 52 of the inkjet head 2 and the recording medium S is constantly maintained while the ink jet printing unit 4 reciprocates along the transport belt 101 in the arrow direction A. The ink jet head 2 includes nozzles 51 that are 300 liquid ejecting units in the longitudinal direction of the nozzle plate 52. The longitudinal direction of the nozzle plate 52 is the same as a transport direction of the recording medium S.

The image forming unit 6 forms an image on the recording medium S while causing the ink jet head 2 to reciprocate in a direction orthogonal to a transport direction of the recording medium S. The ink jet head 2 ejects ink I from the nozzle 51 provided in the nozzle plate 52 in accordance with an image forming signal and forms the image on the recording medium S. The ink jet printing unit 4 forms the image with a width of, for example, 300 nozzles 51 on the recording medium S.

The maintenance unit 310 is a scanning range of the ink jet printing unit 4 in the arrow direction A and is arranged in a position outside of a moving range of the table 103. The ink jet head 2 faces the maintenance unit 310 in a standby position Q. The maintenance unit 310 is a case having an opened upper portion and is provided to be vertically (arrow directions C and D in FIG. 1) movable.

When the carriage 100 moves in the arrow direction A for printing the image, the maintenance unit 310 moves downward (arrow direction C) and separates from the nozzle plate 52. When the print operation is completed, the maintenance unit 310 moves upward (arrow direction D). When the print operation is completed and the ink jet head 2 returns to the standby position Q, the maintenance unit 310 moves upward and covers the nozzle plate 52 of the ink jet head 2. The maintenance unit 310 prevents evaporation of ink from the nozzle plate 52 and prevents dirt and paper dust from adhering to the nozzle plate 52. The maintenance unit 310 performs a cap function with respect to the nozzle plate 52.

The maintenance unit 310 includes a rubber blade 120 and a waste ink receiving unit 130. The rubber blade 120 removes ink, dirt, paper dust, and the like mounted in the nozzle plate 52 of the ink jet head 2. The waste ink receiving unit 130 receives waste ink, dirt, paper dust, and the like generated while performing a maintenance operation. The maintenance unit 310 includes a mechanism of moving the blade 120 in the arrow direction B and wipes a surface of the nozzle plate 52 with the blade 120.

The ink jet head 2 performs maintenance (spit function) by forcedly ejecting ink from the nozzle 51 to remove ink that is degraded near the nozzle. The ink jet head 2 performs maintenance (purge function) by capturing paper dust and dirt attached to the surface of the ink jet head 2 in a flowed-out ink film by slightly flowing out ink from the nozzle 51 and wiping the surface of the ink jet head 2 with the blade 120. The waste ink receiving unit 130 recovers waste ink generated by the spit function or the purge function.

The ink jet printing apparatus 1 is a so-called serial type ink jet printing apparatus which forms an image on the recording medium S by ejecting ink from the nozzle 51 while causing the ink jet head 2 to reciprocate in the direction orthogonal to the transport direction of the recording medium S by the recording medium moving unit 7.

Figure 6:
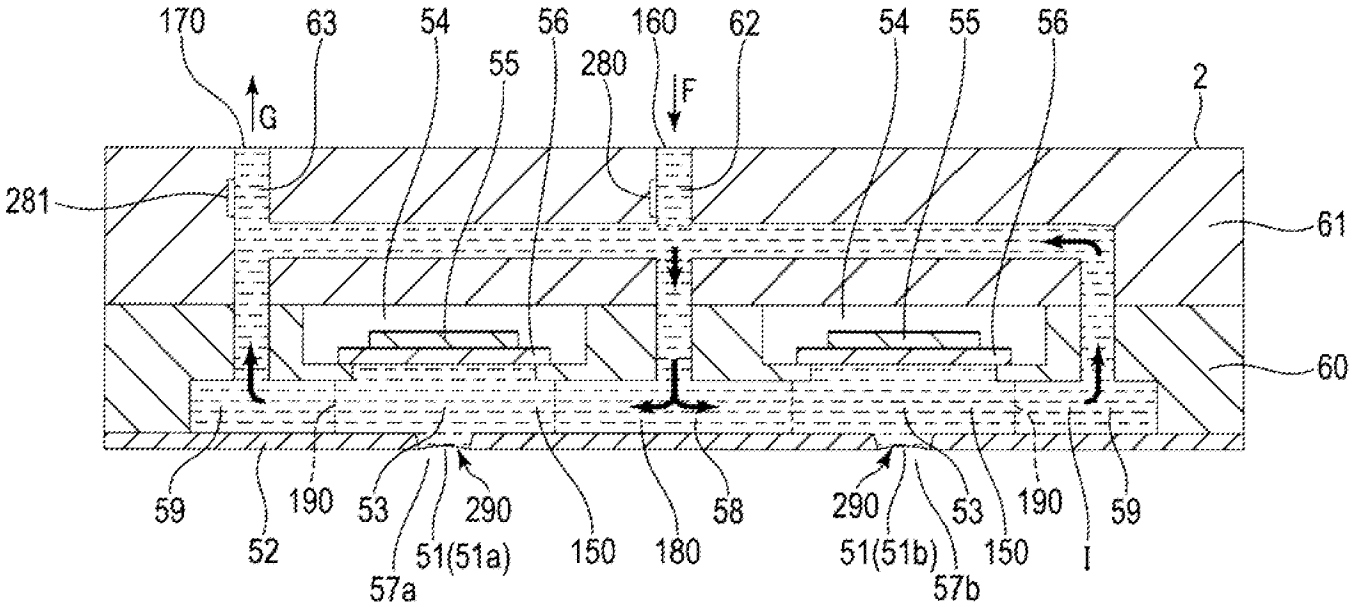
FIG. 6 is a sectional view of an ink jet head according to the first embodiment.
Figure 7:
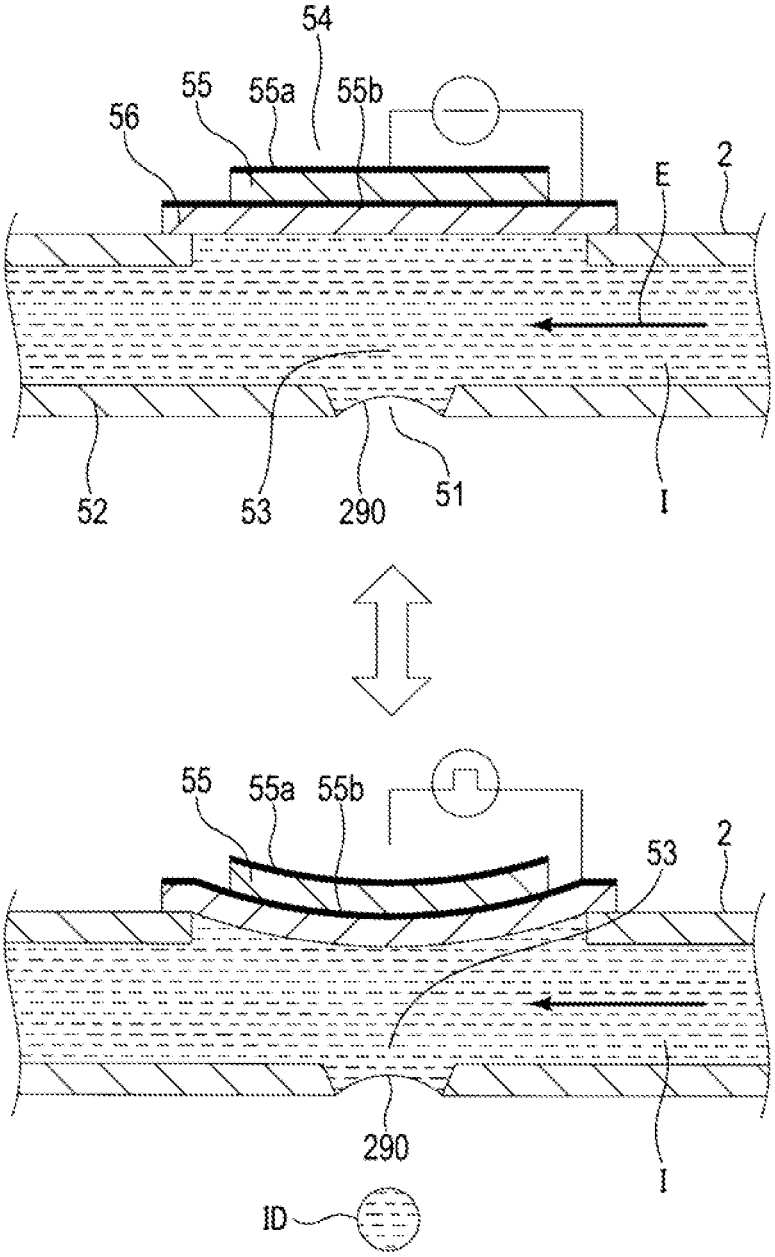
FIG. 7 is a sectional view of the ink jet head.

The ink jet head 2 includes, for example, as illustrated in FIGS. 6 and 7, the nozzle plate 52 including the nozzles 51, a substrate 60 including actuators 54, and a manifold 61 connected to the substrate 60. The substrate 60 includes an ink flow path 180 through which ink flows between the nozzle 51 and the actuator 54. The actuators 54 face the ink flow path 180 and are respectively provided corresponding to each nozzle 51.

The substrate 60 includes boundary walls 190 between adjacent nozzles 51 so that a pressure generated in ink within the ink flow path 180 is concentrated in the nozzle 51 by the actuator 54. A portion of the ink flow path 180 surrounded by the nozzle plate 52, the actuator 54, and the boundary wall 190 serves as an ink pressure chamber 150. A plurality of ink pressure chambers 150 are provided corresponding to each nozzle 51*a* of a first nozzle column 57*a* and each nozzle 51*b* of a second nozzle column 57*b*. The first nozzle column 57*a* and the second nozzle column 57*b* respectively include 300 nozzles 51*a* and 51*b*.

The substrate 60 includes a common ink supply chamber 58 that supplies ink to a plurality of pressure chambers 150 and a common ink chamber 59 that recovers ink from the plurality of ink pressure chambers 150 respectively on the first nozzle column 57*a* side and the second nozzle column 57*b* side.

The manifold 61 includes an ink supply port 160 that is a liquid supply port through which ink flows in arrow direction F. The manifold 61 also includes an ink discharge port 170 that is a liquid discharge port which discharges ink in an arrow direction G. The ink I is supplied from the ink circulating device 3 to the ink supply port 160, and ink flows back from the ink discharge port 170 to the ink circulating device 3. The manifold 61 includes an ink distribution passage 62 communicating with the common ink supply chamber 58 from the ink supply port 160. The manifold 61 includes an ink flow-back passage 63 communicating with the ink discharge port 170 from the common ink chamber 59.

That is, the ink flow path 180 is formed on an inside of the ink jet head 2 by the substrate 60, the manifold 61, and the nozzle plate 52. The ink flow path 180 includes the plurality of ink pressure chambers 150 communicating with the nozzles 51*a* and 51*b*, the ink supply port 160 and the ink discharge port 170 formed in the manifold 61, the common ink supply chamber 58 communicating with the plurality of ink pressure chambers 150, the common ink chamber 59 recovering ink from the plurality of ink pressure chambers 150, the ink distribution passage 62 communicating with the common ink supply chamber 58 from the ink supply port 160, and the ink flow-back passage 63 communicating with the ink discharge port 170 from the common ink chamber 59.

The ink I flowing through the ink distribution passage 62 in an arrow direction F flows into the plurality of ink pressure chambers 150 from the common ink supply chamber 58. An ink branching unit 53 in which ink flowing in an arrow direction E is branched to ink that is ejected from the nozzle 51 and ink that is returned to the ink circulating device 3 by flowing through the ink jet head 2 as it is. The ink I flows into the ink pressure chamber 150 from one end portion flows out from the other end portion through the ink branching unit 53. That is, some of ink is ejected from the nozzle 51 in the ink branching unit 53 within the ink pressure chamber 150 and the remaining ink flows out from the other end portion. The ink I not ejected from the nozzle 51 in the ink pressure chamber 150 flows into the common ink chamber 59 and flows back to the ink flow-back passage 63.

The actuator 54 of the ink jet head 2 includes a unimorph type piezoelectric vibration plate in which, for example, a piezoelectric element 55 and a vibration plate 56 are stacked. The piezoelectric element 55 includes a piezoelectric ceramic material such as lead zirconate titanate (PZT). The vibration plate 56 is formed of, for example, silicon nitride (SiN) and the like.

As illustrated in FIG. 7, the piezoelectric element 55 includes upper and lower electrodes 55*a* and 55*b*. When a voltage is not applied to the electrodes 55*a* and 55*b*, since the piezoelectric element 55 is not deformed, the actuator 54 is not deformed. When the actuator 54 is not deformed, a meniscus 290, which is an interface between the ink I within the nozzle 51 and air, is formed within the nozzle 51 by the surface tension of ink. The ink I within the ink pressure chamber 150 remains within the nozzle 51 by the meniscus 290.

When a voltage (V) is applied to the electrodes 55*a* and 55*b*, the piezoelectric element 55 is deformed and the actuator 54 is deformed. A pressure applied to the meniscus 290 is higher than (positive pressure) an air pressure by deformation of the actuator 54, the ink I breaks the meniscus 290 to become an ink droplet ID, and the ink droplet ID is ejected from the nozzle 51.

The ink jet head is provided to generate a pressure change in ink within the ink pressure chamber, and the structure is not limited. The ink jet head may have a structure that ejects the ink droplet by deforming the vibration plate by, for example, electrostatic force, or the ink jet head may have a structure that ejects the ink droplet from the nozzle by using thermal energy of a heater and the like. In addition, ink viscosity varies according to a temperature and ejecting characteristics from the nozzle are changed. Thus, in order to favorably control ink ejection, the ink jet head may include a temperature sensor.

A head temperature sensor (upstream) 280 that detects an ink temperature supplied to the ink jet head 2 is mounted in the ink distribution passage 62. A head temperature sensor (downstream) 281 that detects an ink temperature discharged from the inkjet head 2 is mounted in the ink flow-back passage 63. The ink temperature supplied to the ink jet head 2 or discharged from the ink jet head 2 is detected by the head temperature sensors 280 and 281. The ink circulating device 3 is controlled by the ink temperature in the ink jet head 2 in consideration of a change of the ink viscosity.

The ink I moves inside of the inkjet head 2 through the ink supply port 160, the ink distribution passage 62, the common ink supply chamber 58, the ink pressure chamber 150, the common ink chamber 59, the ink flow-back passage 63, and the ink discharge port 170 in this order. Some of the ink I is ejected from the nozzle 51 in accordance with an image signal and the remaining ink I moves and flows back from the ink discharge port 170 to the ink circulating device 3.

Figure 3:
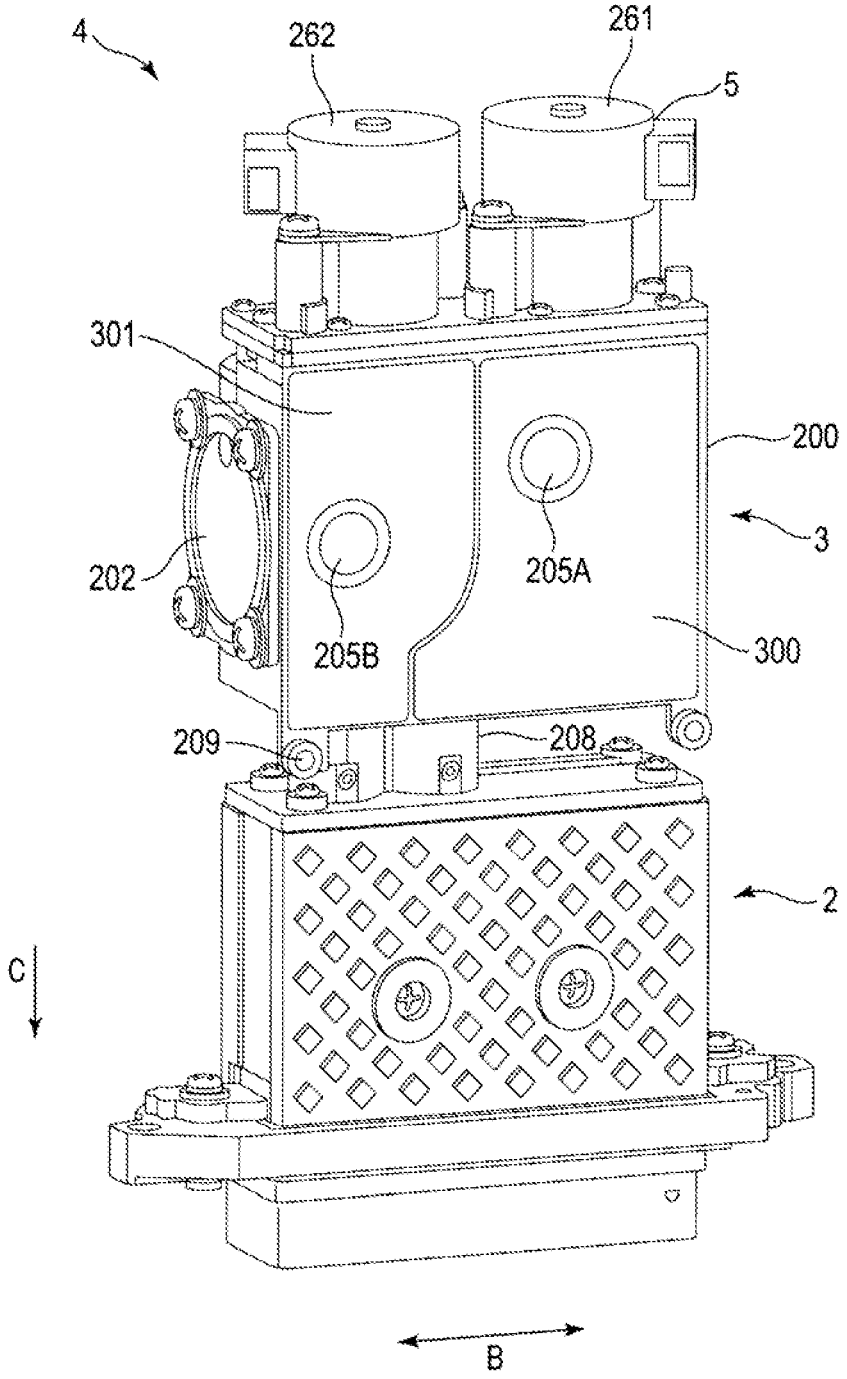
FIG. 3 is a perspective view of an ink jet printing unit according to the first embodiment.
Figure 4:
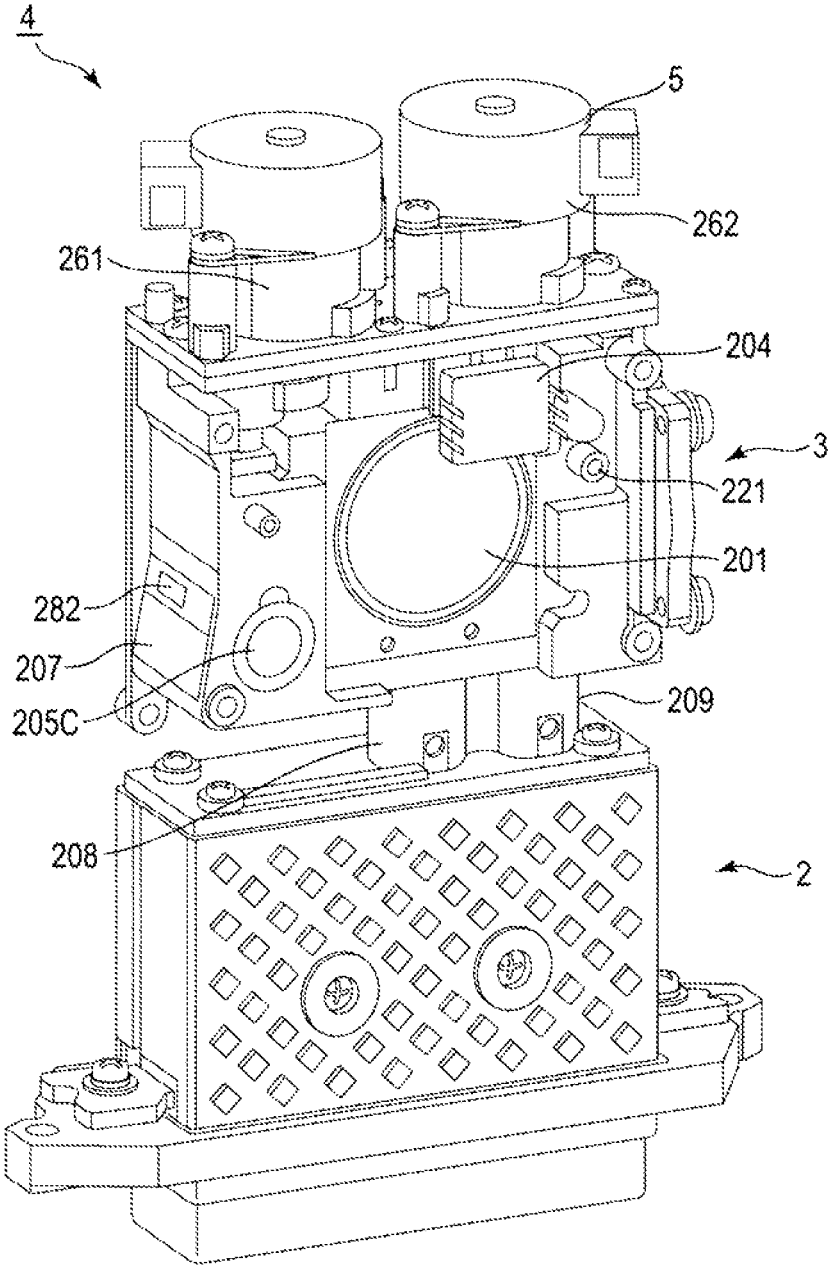
FIG. 4 is a perspective view of the inkjet printing unit.
Figure 5:
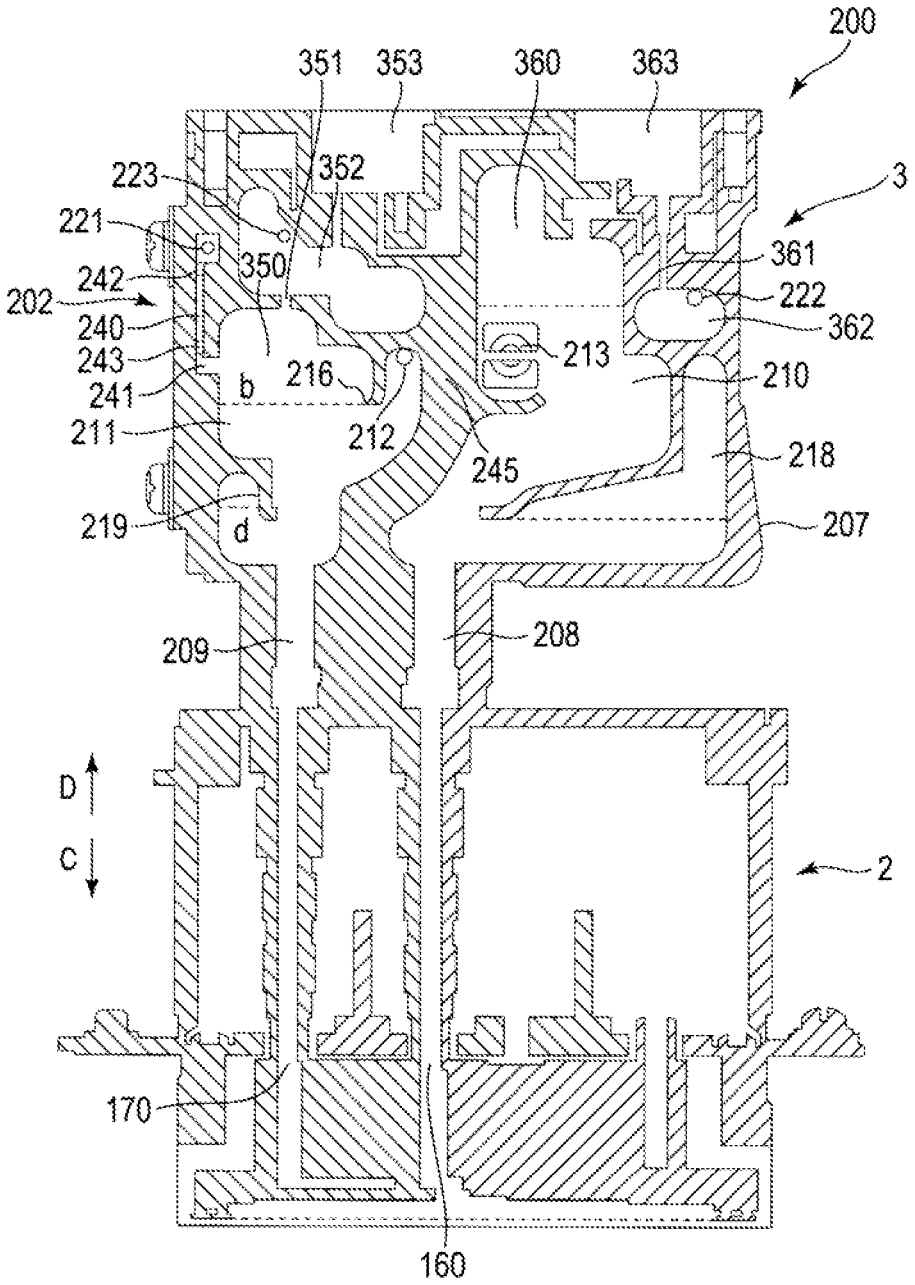
FIG. 5 is a sectional view of the ink jet printing unit.

As illustrated in FIGS. 3 to 5, the ink circulating device 3 includes an ink casing 200, an ink circulating pump 201 that circulates ink, and an ink supply pump 202 that supplies ink from the ink cartridge 81 to the ink casing 200.

The ink casing 200 may be molded of aluminum and may include fixing resin plates 300 and 301 formed of polyimide resin to a frame portion forming a vacant chamber with adhesive. The ink casing 200 is configured so that a supply-side ink chamber 210 communicating with an inside of the ink jet head 2 via an ink supply tube 208 and a recovery-side ink chamber 211 communicating with an inside of the ink jet head 2 via an ink return tube 209 are integrally formed adjacent to each other via a common wall 245. The ink casing 200 includes a suction hole 212 for sucking ink from the recovery-side ink chamber 211 and a discharge hole 213 for feeding ink to the supply-side ink chamber 210.

As illustrated in FIG. 5, two recessed portions 353 and 363 are formed on an upper portion of the ink casing 200. Two projection portions (projection portion 372 and projection portion 370) protruding downward in a lower surface of a base plate 5*a* of the pressure adjusting unit 5 illustrated in FIGS. 8 to 13 are fitted into the recessed portions 353 and 363.

An arrangement direction of the recovery-side ink chamber 211 and the supply-side ink chamber 210 is the same as a nozzle arrangement direction (longitudinal direction of the ink jet head 2 (direction B)) of the ink jet head 2. That is, the arrangement direction of the recovery-side ink chamber 211 and the supply-side ink chamber 210 is a direction substantially orthogonal to a scanning direction of the carriage 100. An upper portion of an ink liquid surface b of the recovery-side ink chamber 211 is a first gas chamber 350 configuring the pressure adjusting unit 5. An upper portion of an ink liquid surface a of the supply-side ink chamber 210 is a second gas chamber 360 configuring the pressure adjusting unit 5.

The ink circulating pump 201 is provided over the recovery-side ink chamber 211 and the supply-side ink chamber 210 adjacent to each other in a surface opposite to the first plate 300 and the second plate 301 as illustrated in FIG. 3. The ink circulating pump 201 sucks ink from the suction hole 212 and feeds ink to the supply-side ink chamber 210 through the discharge hole 213. The ink circulating pump 201 is a piezoelectric pump similar to the ink supply pump 202, feeds ink by periodically changing a volume (pump chamber) on an inside of the pump by deflecting a piezoelectric diaphragm that is formed by bonding a piezoelectric element and a metal plate, and causes an ink feeding direction to be one direction by two check valves. One check valve of the ink circulating pump 201 is provided between the suction hole 212 and the pump chamber, and the other check valve is provided between the pump chamber and the discharge hole 213. One check valve is opened and the other check valve is closed when ink flows into the pump chamber. One check valve is closed and the other check valve is opened when ink flows out from the pump chamber. Ink is fed from the recovery-side ink chamber to the supply-side ink chamber by repeating this operation.

The ink supply pump 202 is provided in an outer wall surface of the ink casing 200. The supply pump 202 is a piezoelectric pump and supplies ink of an amount consumed by printing, a maintenance operation, and the like from an ink supply port 221 to the recovery-side ink chamber 211 on the inside of the ink circulating device 3. The tube 82 feeding ink from the ink cartridge 81 to the ink circulating device 3 is connected to the ink supply port 221 that is an inlet of ink for feeding ink into the ink supply pump 202.

The ink supply pump 202 transports ink by periodically changing a volume (pump chamber 240) on an inside of the pump by deflecting a piezoelectric diaphragm that is formed by bonding a piezoelectric element and a metal plate, and feeds the ink in one direction by two check valves. One check valve 242 of the ink supply pump 202 is provided between the ink supply port 221 and the pump chamber 240, and the other check valve 243 is provided between the pump chamber 240 and an outlet 241 of ink. When the piezoelectric diaphragm is deflected and the pump chamber 240 is expanded, the check valve 242 is opened, ink flows into the pump chamber 240, and the check valve 243 is closed. When the piezoelectric diaphragm is deflected in the opposite direction and the pump chamber 240 is contracted, the check valve 242 is closed, the check valve 243 is opened, and ink flows out from the pump chamber 240. Ink is fed by repeating this operation.

A control substrate 500 is held in the ink jet printing unit 4 so as to cover the ink circulating pump 201. The control substrate 500 controls the ink circulating pump 201, the ink supply pump 202, and the pressure adjusting unit 5.

An ink amount measuring sensor 205A for measuring an ink amount within the ink casing 200 is mounted in the first plate 300. An ink amount measuring sensor 205B is mounted in the second plate 301. An ink amount measuring sensor 205C is configured so that the piezoelectric diaphragm is mounted in the ink casing 200 and vibrates ink on the inside of the ink casing 200 by vibrating the piezoelectric diaphragm by an AC voltage. The vibration of ink transmitting to the inside of the ink casing 200 is detected by the ink amount measuring sensors 205A and 205B, and the ink amount is measured by the ink amount measuring sensor 205C.

A heater 207 for heating ink is provided on the outside of the ink casing 200 to adjust the ink viscosity on the inside of the ink casing 200. The heater 207 is adhered to the ink casing 200 by adhesive having high thermal conductivity. An ink temperature sensor 282 is mounted in the vicinity of the heater 207 of the ink casing 200. The ink temperature sensor 282 and the heater 207 are connected to the control substrate 500 described below, and the heater 207 is controlled to cause the ink viscosity to be a desired ink viscosity during printing.

When the ink circulating pump 201 is operated, ink is sucked from the recovery-side ink chamber 211 through the suction hole 212 and is transported to the supply-side ink chamber 210 through the ink circulating pump 201 and the discharge hole 213. An internal pressure of the supply-side ink chamber 210 that is sealed increases due to an increase in the ink amount and ink flows into the ink jet head 2 through the ink supply tube 208.

The ink cartridge 81 supplying ink to the recovery-side ink chamber 211 is arranged relatively below the ink circulating device 3 in the direction of gravity (direction C). A water head pressure of ink on the inside of the cartridge 81 is held to be lower than a set pressure of the recovery-side ink chamber 211 by arranging the cartridge 81 below the ink circulating device 3. The ink I is supplied to the recovery-side ink chamber 211 according to this configuration only when the ink supply pump 202 is driven.

The ink circulating device 3 circulates ink by supplying the ink I to the ink jet head 2, recovering the ink I that was not ejected from the nozzle 51, and supplying the recovered ink to the ink jet head 2 again. The ink circulating device 3 feeds ink downward (arrow direction C that is the direction of gravity) through the ink supply tube 208 and the ink jet head 2 ejects ink further downward.

The meniscus 290 is formed in the nozzle 51 of the ink jet head 2. When ink is ejected from the nozzle 51, the meniscus 290 that is the interface between ink and air is broken and ink is ejected as the ink droplet. When a pressure applied to the meniscus 290 is higher than an air pressure (positive pressure), ink is leaked from the nozzle 51. When the pressure applied to the meniscus 290 is lower than the air pressure (negative pressure), ink maintains the meniscus 290 and remains on the inside of the nozzle 51. Thus, when ink is not ejected, the pressure of ink on the inside of the ink pressure chamber 150 is adjusted to be between −0.5 kPa to −4.0 kPa (gage pressure) and maintains the meniscus 290. Since the nozzle 51 is arranged so as to eject ink downward in the direction of gravity, when the pressure is greater than this range (positive pressure side), ink is leaked from the nozzle by slight vibration and the like. In addition, when the pressure is less than this range (negative pressure side), air is sucked from the nozzle and ejection failure occurs. Usually, the inside of the ink pressure chamber 150 is maintained at the negative pressure and when the actuator 54 is operated, ink on the inside of the ink pressure chamber is at the positive pressure and ink is ejected from the nozzle 51. Ink flow path resistances from the supply-side ink chamber 210 and the recovery-side ink chamber 211 to the nozzle 51 of the ink jet head 2 are substantially equal to each other. Since the ink flow path resistances are substantially equal to each other, the pressure of the nozzle 51 is obtained by adding an average valve of pressures due to water head difference between the nozzle surface and the ink surfaces of both ink chambers to an average valve of the pressure of the second gas chamber 360 and the pressure of the first gas chamber 350. Good ink ejection is maintained by adjusting the pressure so that the pressure of the nozzle 51 becomes a predetermined pressure in the pressure adjusting unit 5.

Figure 8:
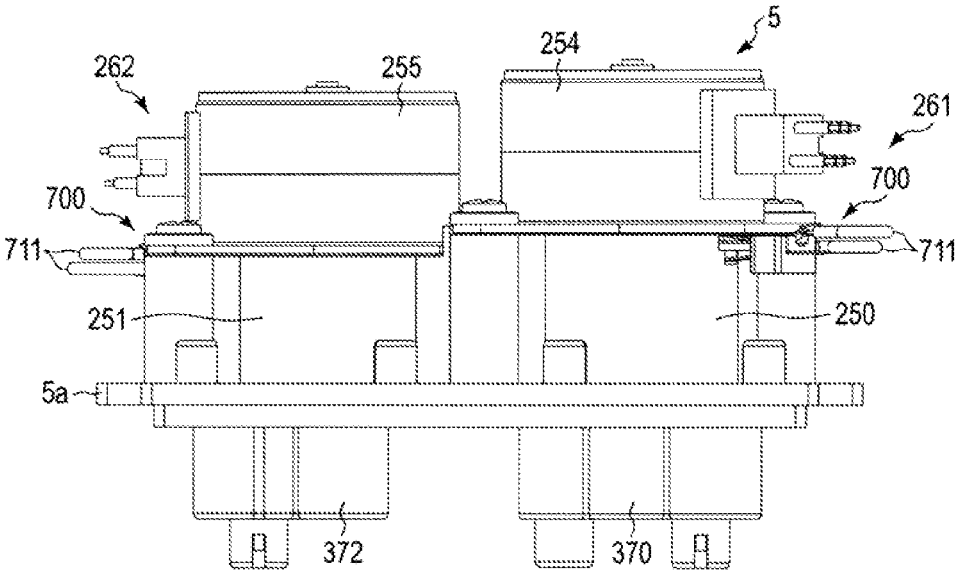
FIG. 8 is a side view of a pressure adjusting unit according to the embodiment.
Figure 9:
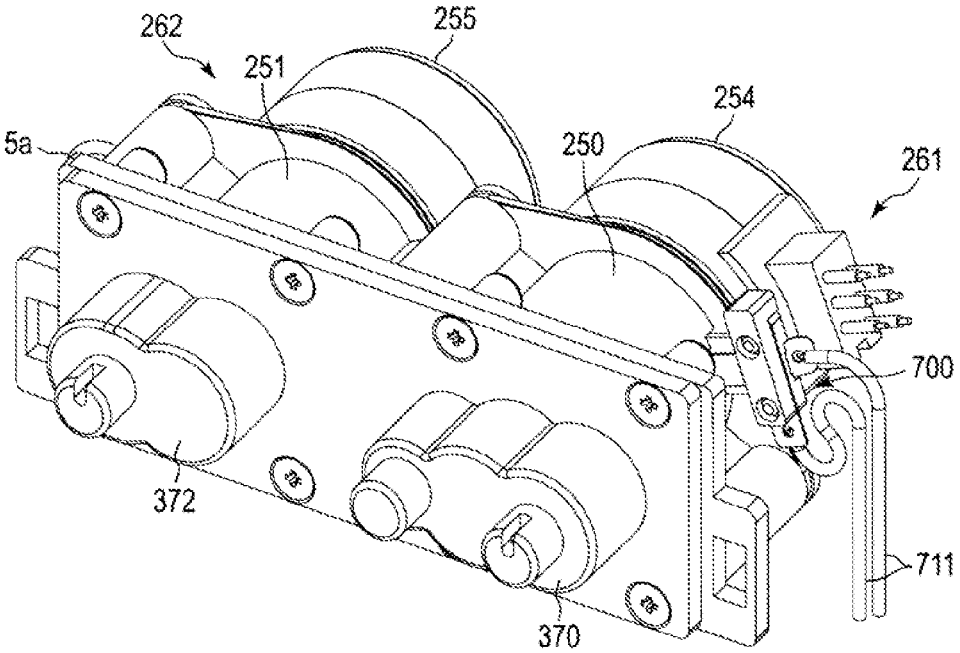
FIG. 9 is a perspective view of the pressure adjusting unit according to the embodiment.
Figure 10:
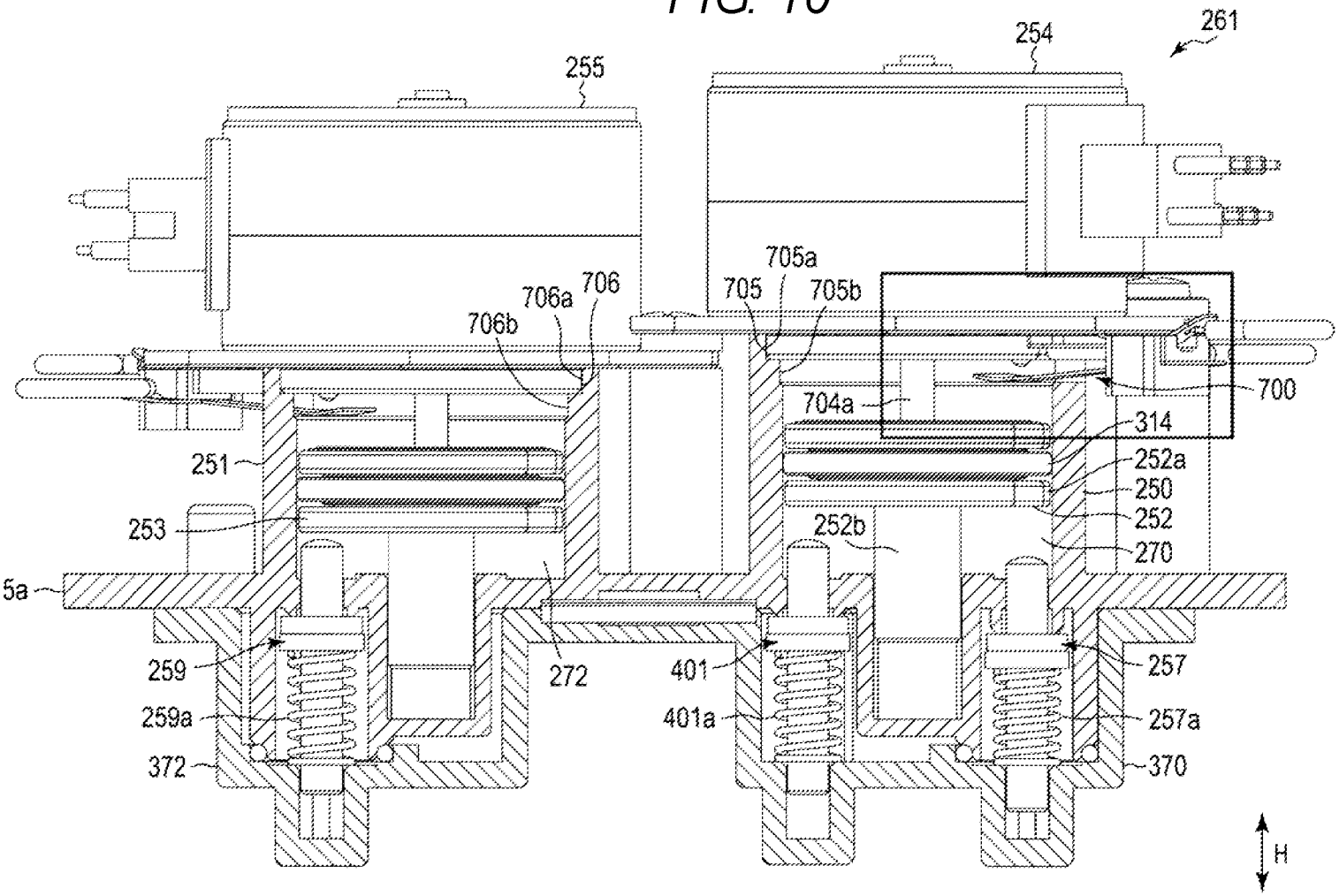
FIG. 10 is a sectional view of an internal configuration of the pressure adjusting unit according to the embodiment.
Figure 11:
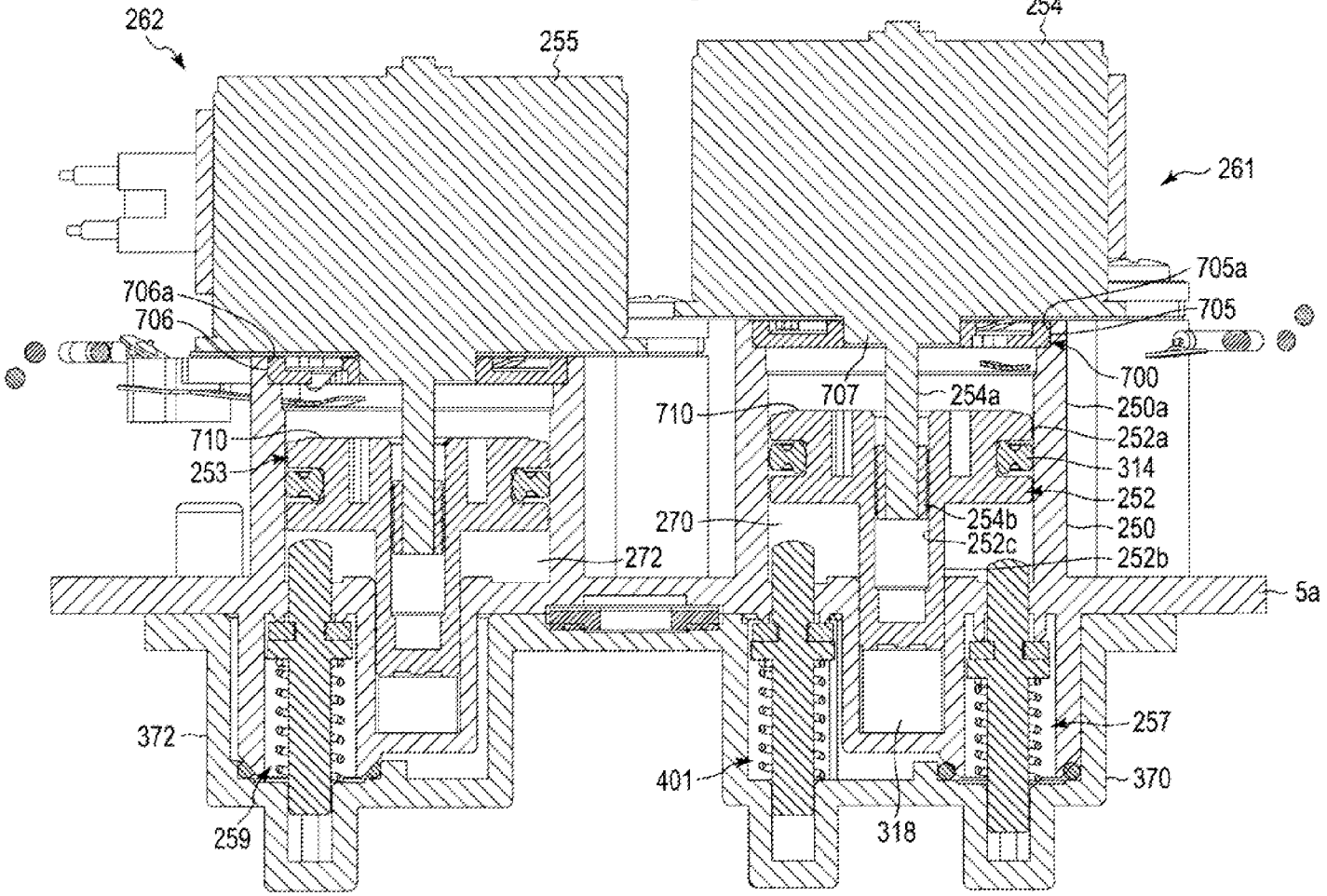
FIG. 11 is a vertical sectional view illustrating the internal configuration of the pressure adjusting unit according to the embodiment.
Figure 12:
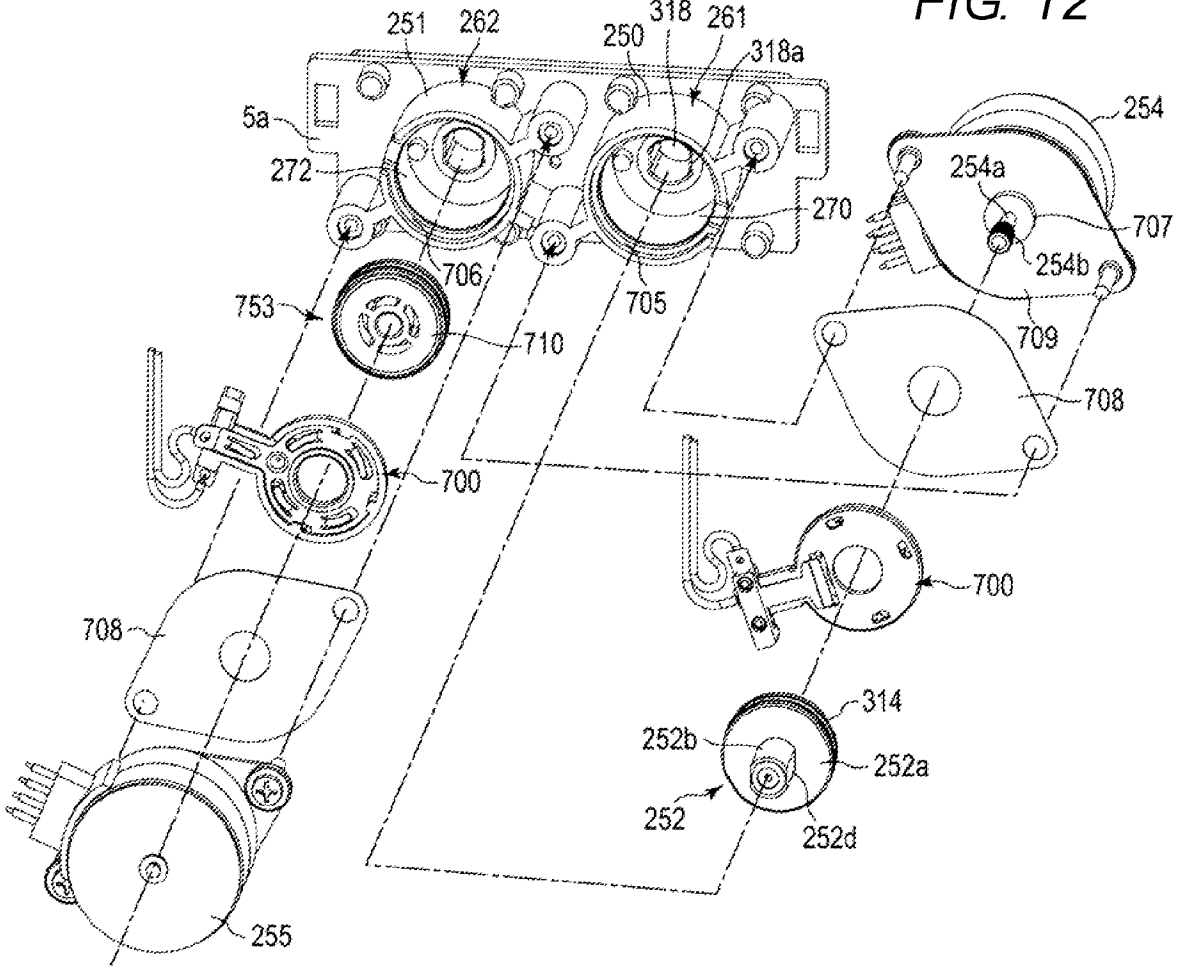
FIG. 12 is an exploded perspective view of the pressure adjusting unit according to the embodiment.

The pressure adjusting unit 5 will be described with reference to FIGS. 8 to 13. FIG. 8 is a side view of the pressure adjusting unit 5, FIG. 9 is a perspective view of the pressure adjusting unit 5, FIG. 10 is explanatory sectional view of an internal configuration of the pressure adjusting unit 5, FIG. 11 is a vertical sectional view illustrating the internal configuration of the pressure adjusting unit 5, FIG. 12 is an exploded perspective view of the pressure adjusting unit 5, and FIG. 13 is a sectional view of the pressure adjusting unit 5.

The pressure adjusting unit 5 is provided on the ink casing 200 of the circulating device 3. The pressure adjusting unit 5 adjusts the pressure on the inside of the ink casing 200 to appropriately maintain the ink pressure on the inside of the nozzle 51 of the ink jet head 2. The pressure adjusting unit 5 includes two pressure adjusting chambers (first pressure adjusting chamber 261 and second pressure adjusting chamber 262).

The first pressure adjusting chamber 261 includes a cylinder 250, a piston 252, and a pulse motor 254. The cylinder 250 forms a fourth gas chamber 270. The piston 252 is a first movable body positioned on an inside of the cylinder 250. The pulse motor 254 is a first volume variable unit for changing a volume of the cylinder 250 by advancing and retracting the piston 252, for example, in a direction H in FIG. 10.

Figure 13:
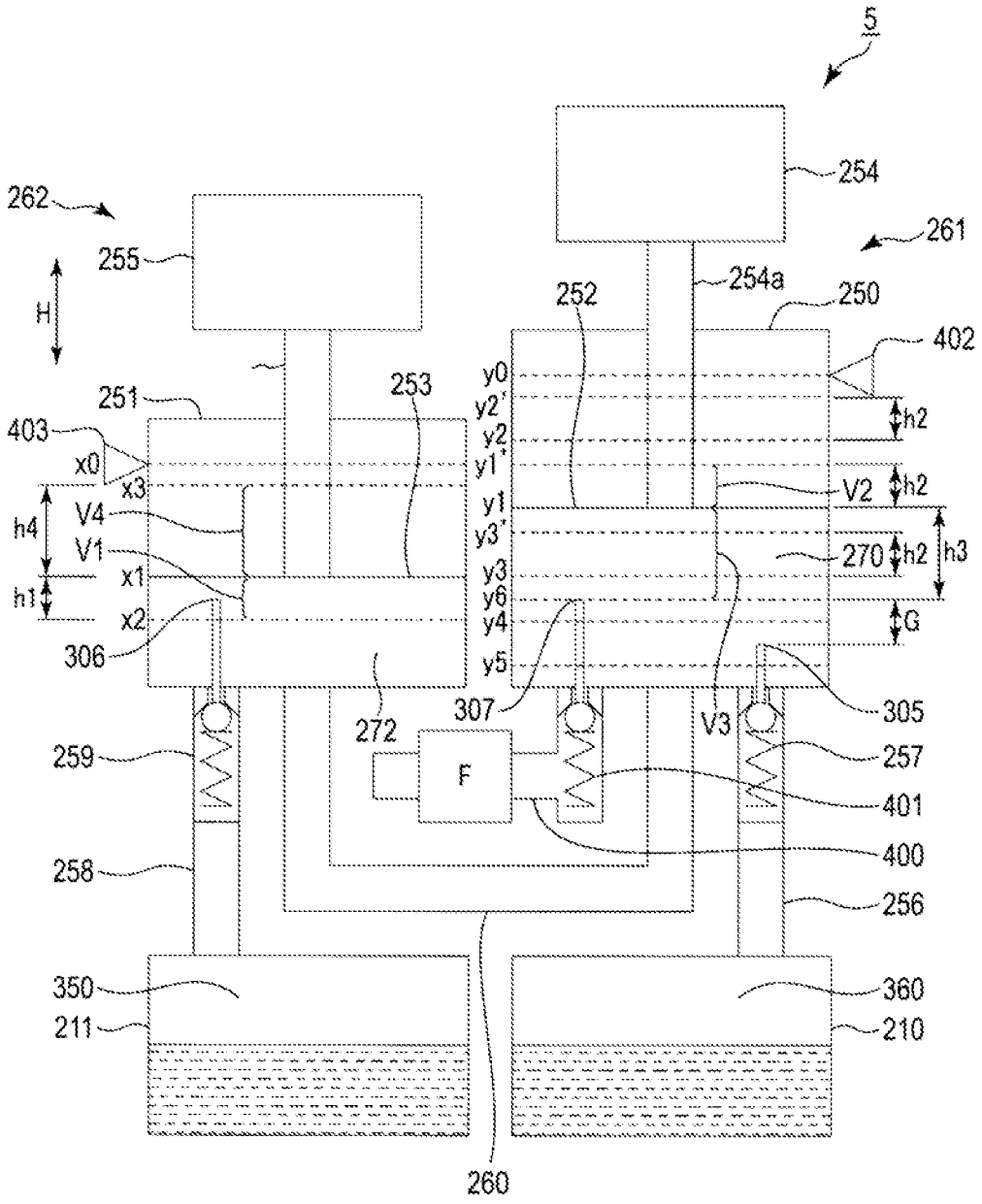
FIG. 13 is a sectional view of the pressure adjusting unit according to the embodiment.

The fourth gas chamber 270 formed on the inside of the cylinder 250, as illustrated in FIG. 13, communicates with the supply-side ink chamber 210 via a communication duct 256 and is able to open and close with respect to atmosphere through a communication duct 400. A spring 257*a*, a second opening and closing member 257 as a second opening and closing unit are mounted on the inside of the communication duct 256. The second opening and closing member 257 closes the communication duct 256 (path) between the cylinder 250 and the second gas chamber 360 on the inside of the supply-side ink chamber 210 by being urged by the spring 257*a*, and opens the communication duct 256 by being pressed by the piston 252.

A spring 401*a* and an opening and closing member 401 as a third opening and closing unit is mounted on the inside of the communication duct 400. The opening and closing member 401 closes the communication duct 400 (path) with the atmosphere by biasing of the spring 401*a* and opens the communication duct 400 with the atmosphere by being pressed by the piston 252. A filter F is provided in an air inlet to the communication duct 400.

The piston 252 includes a disc-shaped piston body 252*a*, a shaft portion 252*b*, and a female screw 252*c*. The piston body 252*a* slides on the inside of the cylinder 250 in the direction H in FIG. 10. A rubber seal member 314 is mounted on an outer peripheral surface of the piston body 252*a* and maintains on the inside of the cylinder 250 in air-tight. The shaft portion 252*b* protrudes on one surface side (surface on a side opposite to the pulse motor 254) of a center portion of the piston body 252*a*. A flat portion 252*d* is formed in the outer peripheral surface of the shaft portion 252*b*. The female screw 252*c* is formed in a center portion of the piston 252.

The cylinder 250 is configured so that one end of a cylindrical cylinder body 250*a* is fixed to the base plate 5*a* of the pressure adjusting unit 5. The other end of the cylinder body 250*a* is fixed to the pulse motor 254. A rotation shaft 254*a* of the pulse motor 254 is fixed to a male screw 254*b*. The male screw 254*b* is screwed into the female screw 252*c* of the piston 252.

In addition, a cylindrical shaft hole 318 is formed in the base plate 5*a* of the pressure adjusting unit 5. A flat portion 318*a* having a shape corresponding to the flat portion 252*d* of the shaft portion 252*b* of the piston 252 is formed in the shaft hole 318. Then, the shaft portion 252*b* of the piston 252 is slidably fitted into the shaft hole 318 and prevents the rotation of the piston 252. Thus, the male screw 254*b* is rotated by rotation of the pulse motor 254. The rotation of the male screw 254*b* is transmitted to the piston 252 via a screwing portion with the female screw 252*c*. In this case, the shaft portion 252*b* of the piston 252 prevents the piston 252 from rotating by fitting with the shaft hole 318. Thus, the piston 252 vertically slides on the inside of the cylinder 250 via the screwing portion of the male screw 254*b* and the female screw 252*c* while the pulse motor 254 rotates. Then, a converting member for converting a rotational movement of the pulse motor 254 into a translational movement in the axial direction of the piston 252 is formed by the screwing portion of the male screw 254*b* and the female screw 252*c*, and the fitting portion of the shaft portion 252*b* of the piston 252 and the shaft hole 318. The volume of the fourth gas chamber 270 surrounded by the cylinder 250 and the piston 252 is changed and the pressure is changed by the translational movement of the piston 252 in the axial direction.

The second pressure adjusting chamber 262 includes a cylinder 251, a piston 253, and a pulse motor 255. The cylinder 251 communicates with the recovery-side ink chamber 211. The piston 253 is a second movable body accommodated on an inside of the cylinder 251. The pulse motor 255 is a second volume variable unit for changing a volume of the cylinder 251 by advancing and retracting the piston 253, for example, in a direction H.

The cylinder 251, the piston 253, and the pulse motor 255 are configured to be the same as the first pressure adjusting chamber 261. A volume of a third gas chamber 272 surrounded by the cylinder 251 and the piston 253 is changed and the pressure is changed.

The cylinder 251 includes a communication tube 258 communicating with the recovery-side ink chamber 211. A spring 259*a*, and an opening and closing member 259 that is a first opening and closing unit are mounted on an inside of the communication tube 258. The opening and closing member 259 closes a communication hole communicating the cylinder 251 with the first gas chamber 350 on the inside of the recovery-side ink chamber 211 by biasing of the spring 259*a* and opens the communication hole when the opening and closing member 259 is pressed by the piston 253.

The piston 253 vertically slides on the inside of the cylinder 251, changes a volume of the third gas chamber 272 surrounded by the cylinder 251 and the piston 253, and changes the pressure by the rotation of the pulse motor 255.

As illustrated in FIG. 5, the first gas chamber 350 of the recovery-side ink chamber 211 communicates with a fifth gas chamber 352 above the first gas chamber 350 through a path provided in one projection portion 372 protruding downward in the lower surface of the base plate 5*a* and an opening 351. A communication passage 223 connected to a detection unit of a pressure sensor 204 is provided in the fifth gas chamber 352. The second gas chamber 360 containing air in contact with the liquid surface a of the supply-side ink chamber 210 communicates with a sixth gas chamber 362 through a path provided in the projection portion 370 and an opening 361. A communication passage 222 connected to the detection unit of the pressure sensor 204 is provided in the sixth gas chamber 362.

The pressure sensor 204 detects each pressure of the second gas chamber 360 on the inside of the supply-side ink chamber 210 and the first gas chamber 350 on the inside of the recovery-side ink chamber 211. The pressure sensor 204 has two pressure detection ports with one chip, communicates with the first gas chamber 350 and the second gas chamber 360, and measures the pressure of two gas chambers 350 and 360. The pressure sensor 204 is connected to the control substrate 500 and outputs an air pressure of an upper portion of the supply-side ink chamber 210 and an upper portion of the recovery-side ink chamber 211 as electric signals.

As illustrated in FIG. 13, a communication path 260 that communicates the cylinder 250 with the cylinder 251 is provided between two cylinders 250 and 251 of the pressure adjusting unit 5. That is, the pressure adjusting unit 5 includes the third gas chamber 272, the opening and closing member 259 that is the first opening and closing unit, the fourth gas chamber 270, the opening and closing member 257 that is the second opening and closing unit, the communication path 260, the opening and closing member 401 that is the third opening and closing unit, the piston 253 that is the first volume variable unit, and the piston 252 that is the second volume variable unit.

The pressure adjusting unit 5 vertically moves each of two pistons 252 and 253, changes the volume of air of the cylinders 250 and 251, and opens and closes the flow path by switching three opening and closing members 259, 257, and 401. Therefore, the pressure on the inside of the ink casing 200 is adjusted and the pressure of the meniscus 290 of the ink jet head 2 is maintained at an appropriate range.

In the pressure adjusting unit 5 according to the embodiment, a home switch 700 that is a mechanical switch is incorporated into each of the first pressure adjusting chamber 261 and the second pressure adjusting chamber 262. Hereinafter, the home switch 700 will be described with reference to FIGS. 14 to 22. Moreover, two home switches 700 respectively incorporated into the first pressure adjusting chamber 261 and the second pressure adjusting chamber 262 have the same structure. Thus, a structure of the home switch 700 of the first pressure adjusting chamber 261 is described and the same reference numerals are given to the same portions of the home switch 700 of the second pressure adjusting chamber 262 and the description will be omitted.

Figure 14:
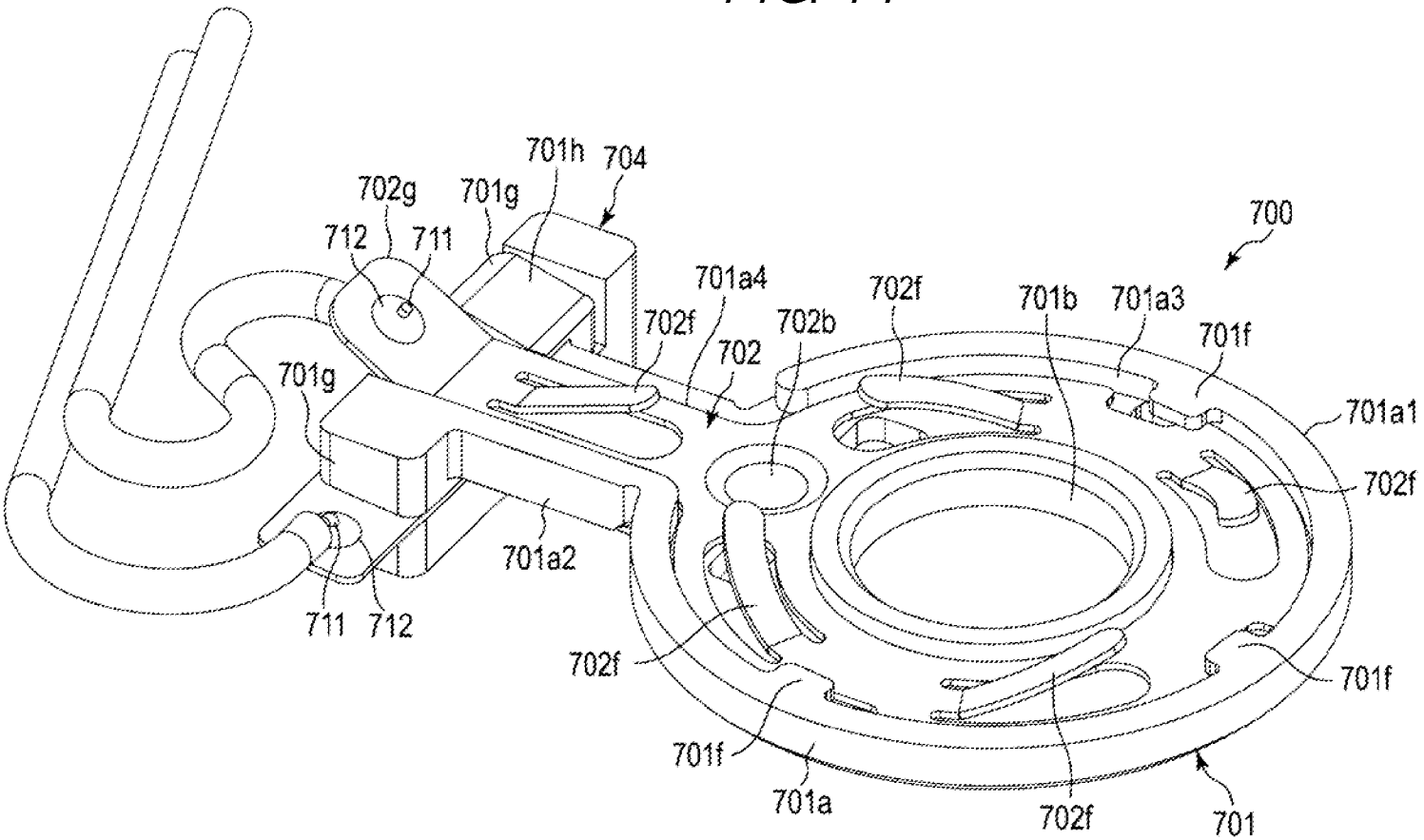
FIG. 14 is a perspective view of a home switch.
Figure 15A:
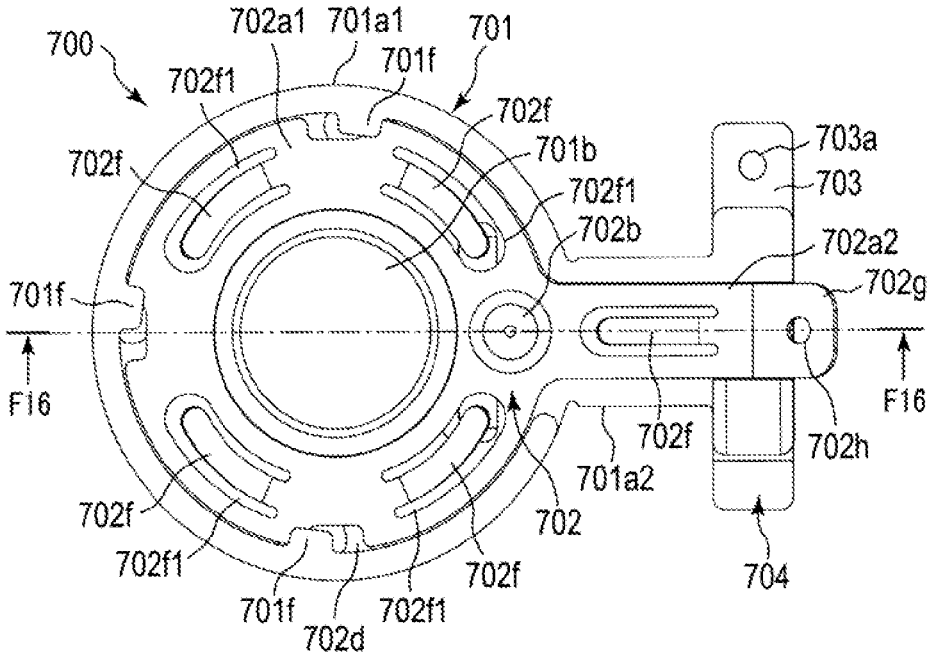
FIG. 15A is a plan view of the home switch.
Figure 15B:
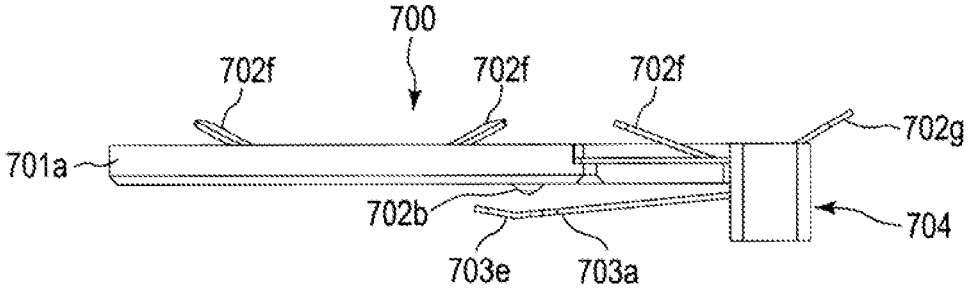
FIG. 15B is a side view of the home switch.
Figure 15C:
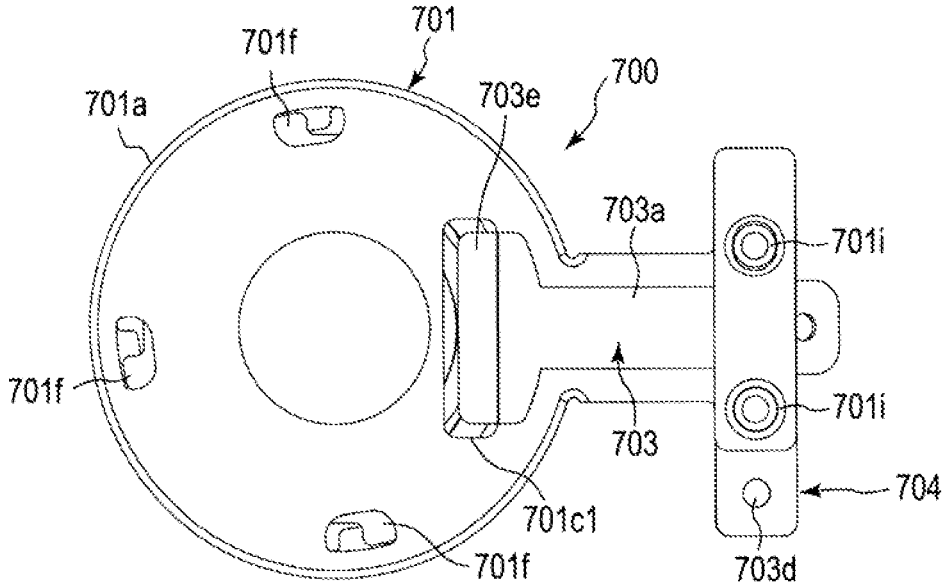
FIG. 15C is a plan view of the home switch on a rear surface side of FIG. 15A.
Figure 16:
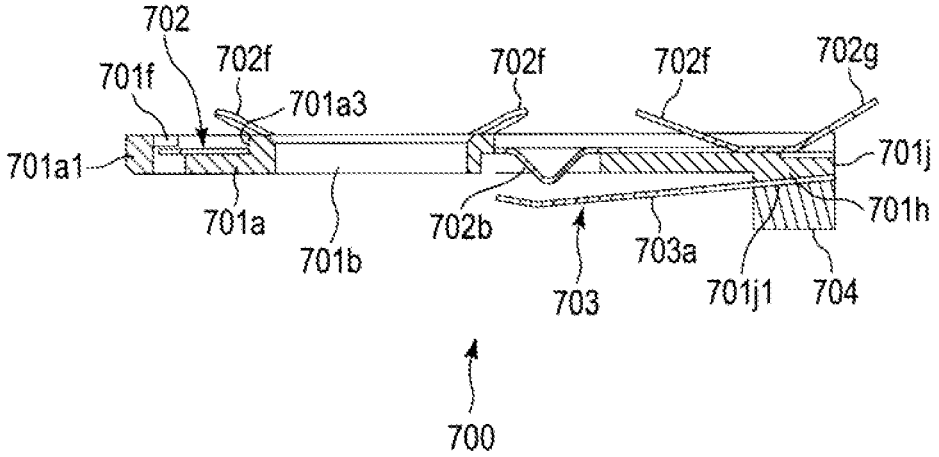
FIG. 16 is a sectional view that is taken along line F16-F16 of FIG. 15A.
Figure 17:
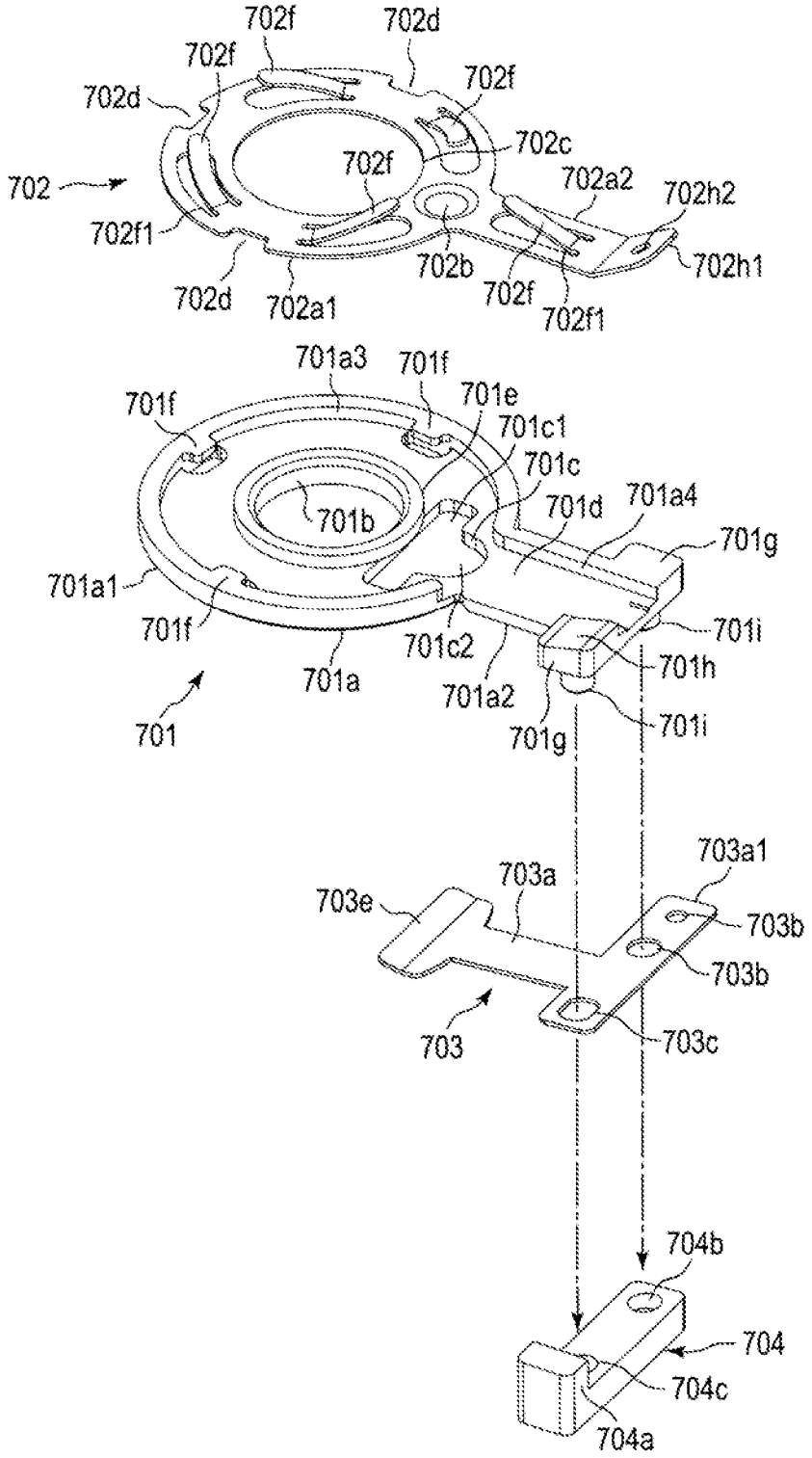
FIG. 17 is an exploded perspective view of the home switch.
Figure 18:
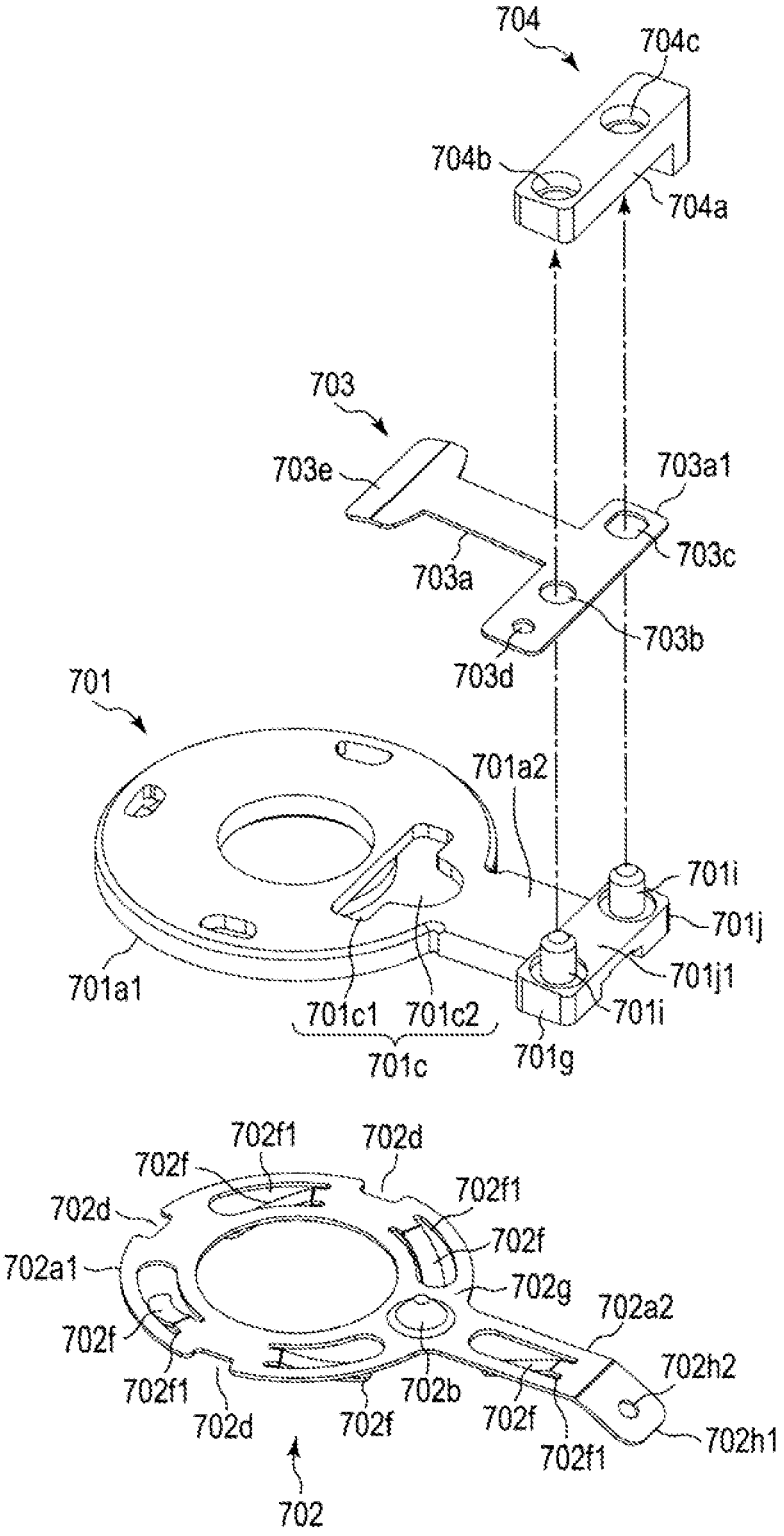
FIG. 18 is an exploded perspective view of the home switch on a side opposite to FIG. 17.
Figure 19:
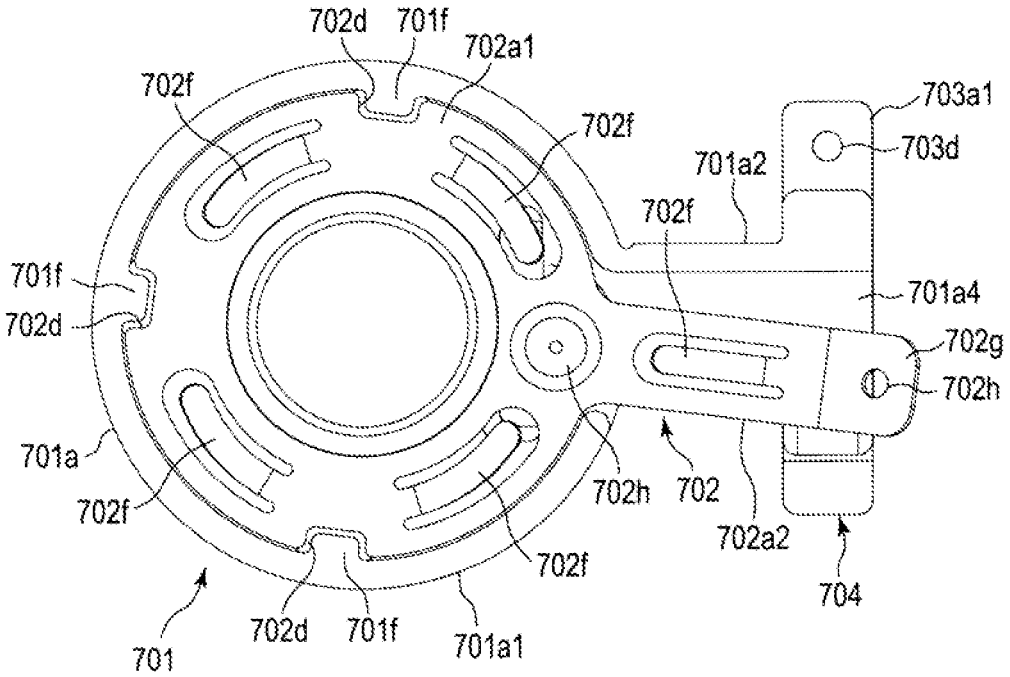
FIG. 19 is a plan view illustrating a method for assembling a first contact terminal of the home switch to a housing.
Figure 20:
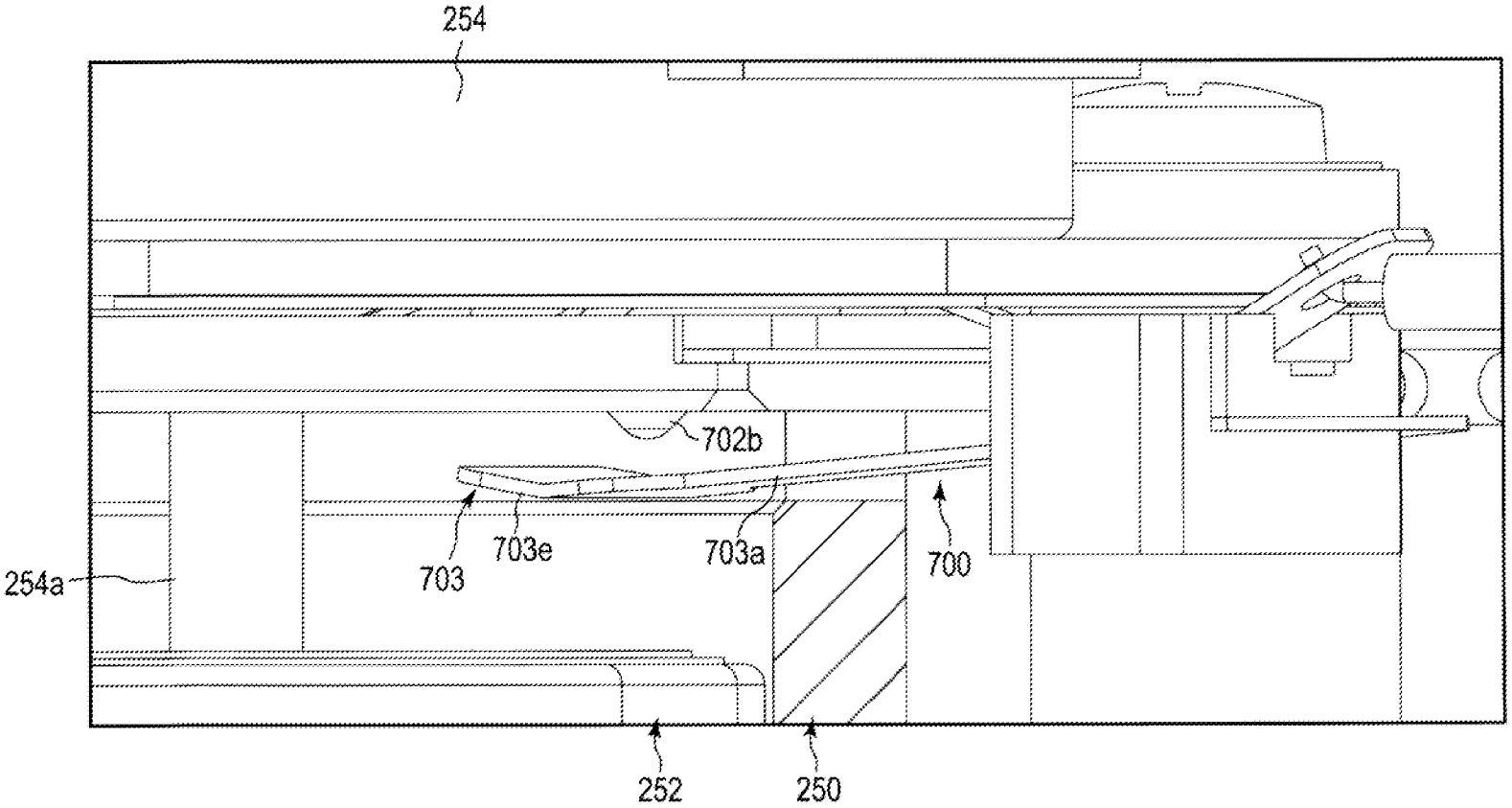
FIG. 20 is a partial sectional view before the home switch is operated.
Figure 21:
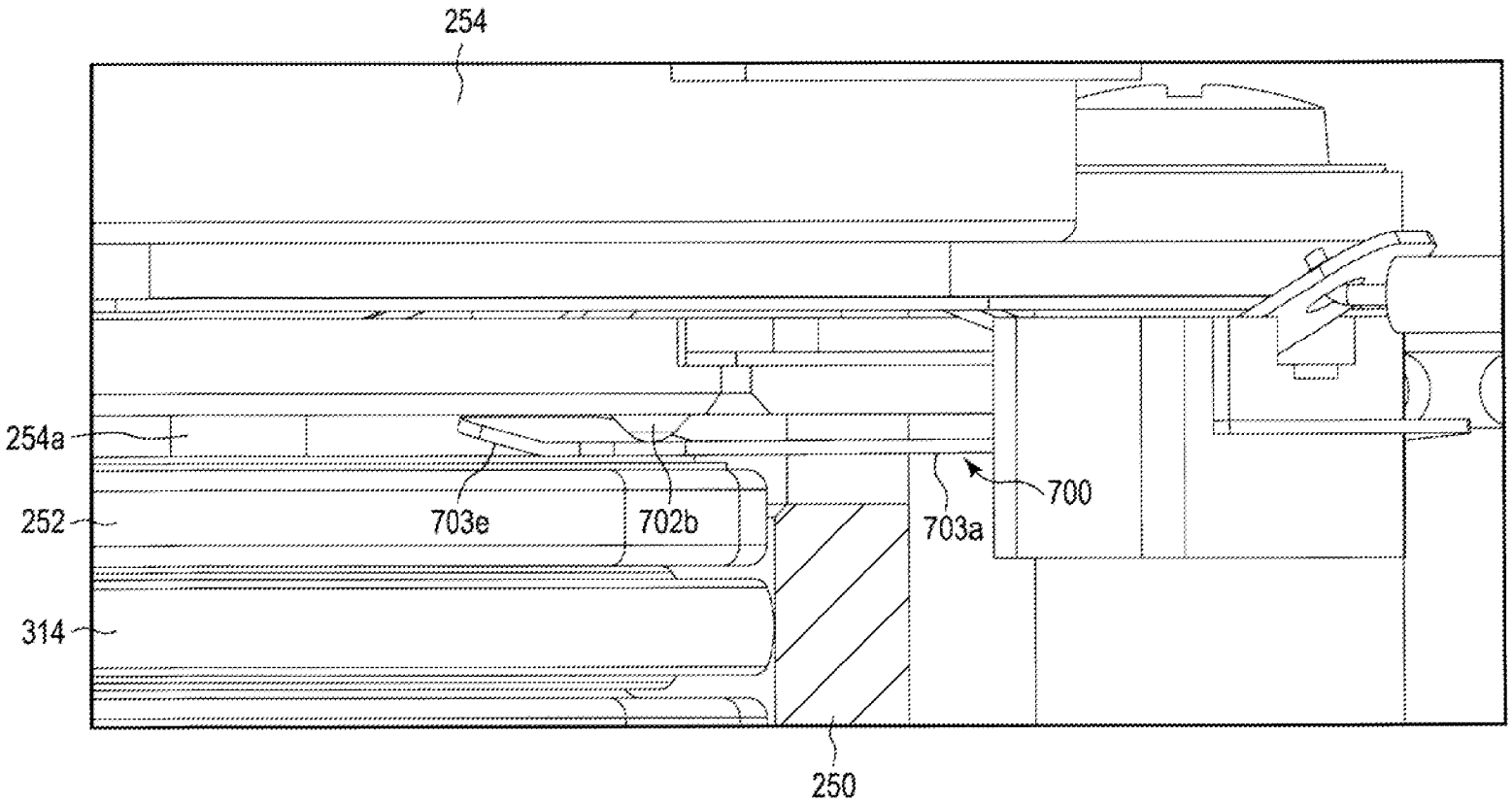
FIG. 21 is a partial sectional view after the home switch is operated.
Figure 22:
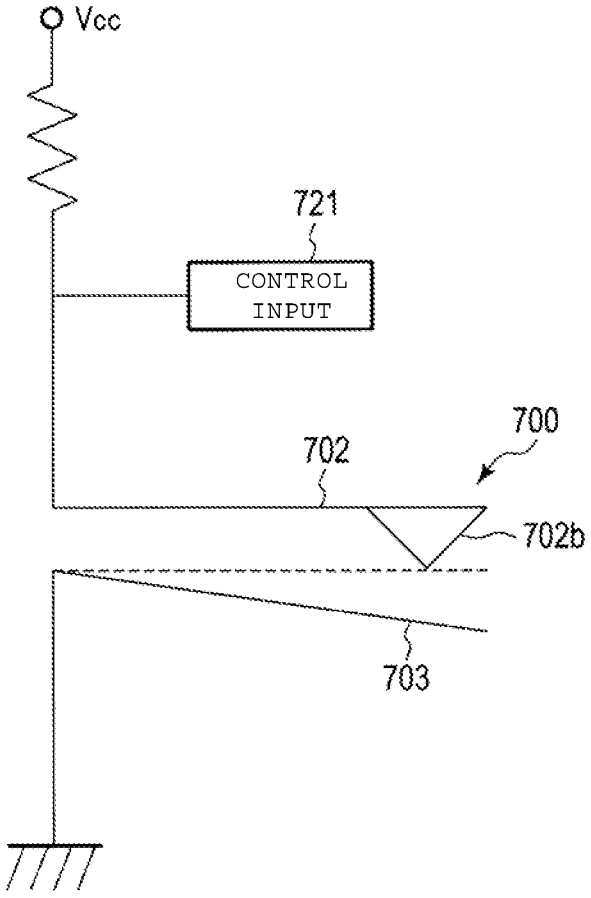
FIG. 22 is a schematic configuration of the home switch.

FIG. 14 is a perspective view of the home switch 700. FIGS. 15A to 15C illustrate an entire configuration of the home switch 700, FIG. 15A is a plan view of the home switch 700, FIG. 15B is a side view, and FIG. 15C is a plan view on a rear surface side of FIG. 15A. FIG. 16 is a sectional view that is taken along line F16-F16 of FIG. 15A. FIG. 17 is an exploded perspective view of the home switch 700. FIG. 18 is an exploded perspective view of the home switch 700 on the opposite side of FIG. 17. FIG. 19 is a plan view describing a method for assembling a first contact terminal 702 of the home switch 700 to a housing 701. FIG. 20 is a partial sectional view before the home switch 700 is operated. FIG. 21 is a partial sectional view after the home switch 700 is operated. FIG. 22 is a schematic configuration of the home switch 700.

Mounting units 705 and 706 of the home switch 700 are respectively provided in two of the first pressure adjusting chamber 261 and the second pressure adjusting chamber 262 of the pressure adjusting unit 5. Here, as illustrated in FIG. 10, a circular recessed portion (fitting hole portion) 705*a* is formed on an inner peripheral surface side in an end edge portion on a bonding end portion side with the pulse motor 254 in the cylinder 250 of the first pressure adjusting chamber 261. A diameter of the recessed portion 705*a* is set to be greater than a diameter of an inner diameter of the cylinder body 250*a*. Furthermore, a small diameter recessed portion 705*b* having a diameter smaller than that of the recessed portion 705*a* is formed below the recessed portion 705*a*. Thus, a two-stepped portion is formed in the end edge portion on the bonding end portion side with the pulse motor 254 in the cylinder 250 by the recessed portion 705*a* and the small diameter recessed portion 705*b*. The mounting unit 705 of the first pressure adjusting chamber 261 is formed by the recessed portion 705*a* of the cylinder 250. A coaxial positioning shaft portion 707 having a large diameter is formed in a base end portion of the rotation shaft 254*a* in the pulse motor 254.

The mounting unit 706 of the second pressure adjusting chamber 262 is also formed in a similar manner. That is, a circular recessed portion (fitting hole portion) 706*a* and a small diameter recessed portion 706*b* are formed on an inner peripheral surface side of an end edge portion on a bonding end portion side with the pulse motor 255 in the cylinder 251. The mounting unit 706 of the second pressure adjusting chamber 262 is formed by the recessed portion 706*a*.

The home switch 700 includes the housing 701 that also serves as a positioning member, the first contact terminal 702, a second contact terminal 703, and a cap member 704. The housing 701 includes a ring-shaped first holding portion 701*a*1 and a linear second holding portion 701*a*2. One end portion (inner end portion) of the second holding portion 701*a*2 is connected to a part of an outer peripheral portion of the first holding portion 701*a*1.

The first holding portion 701*a*1 includes a ring-shaped groove 701*a*3 on a surface side. Similarly, a linear groove 701*a*4 is formed on a surface side of the second holding portion 701*a*2. Groove depths of the ring-shaped groove 701*a*3 and the linear groove 701*a*4 are the same. Then, one end portion (inner end portion) of the linear groove 701*a*4 is connected to the ring-shaped groove 701*a*3. Then, a reference flat portion 701*d* determining a mounting position of the first contact terminal 702 is formed by groove bottom surfaces of the ring-shaped groove 701*a*3 and the linear groove 701*a*4.

The outer peripheral surface of the first holding portion 701*a*1 of the housing 701 becomes a fitting shaft portion 701*a* fitted into the recessed portion (fitting hole portion)

705*a* of the mounting unit 705 of the cylinder 250 of the pressure adjusting unit 5. The inner peripheral surface of the first holding portion 701*a*1 becomes a fitting hole portion 701*b* fitted into the positioning shaft portion 707 of the pulse motor 254. When the home switch 700 is assembled to the first pressure adjusting chamber 261, the fitting shaft portion 701*a* of the outer peripheral surface of the first holding portion 701*a*1 of the housing 701 is fitted into the recessed portion (fitting hole portion) 705*a* of the mounting unit 705 of the cylinder 250. Furthermore, the fitting hole portion 701*b* of the inner peripheral surface of the first holding portion 701*a*1 is fitted into the positioning shaft portion 707 of the pulse motor 254. Therefore, it is possible to accurately perform positioning between the cylinder 250 and the shaft of the pulse motor 254. Moreover, similar to the positioning structure of the cylinder 251 and the shaft of the pulse motor 255, it is also possible to accurately perform positioning between the cylinder 251 and the shaft of the pulse motor 255.

An opening portion 701*c* is formed in the vicinity of a connection portion of the second holding portion 701*a*2 in the first holding portion 701*a*1 in the housing 701. The opening portion 701*c* includes a linear through-hole portion 701*c*1 that is arranged on an inner peripheral portion side of the ring-shaped groove 701*a*3 of the first holding portion 701*a*1 and a substantially semi-circular through-hole portion 701*c*2 that is arranged on an outer peripheral portion side of the ring-shaped groove 701*a*3. The through-hole portion 701*c*1 and the through-hole portion 701*c*2 are integrally formed in communication with each other.

Furthermore, the first holding portion 701*a*1 of the housing 701 includes a fitting shaft portion 701*e* formed by an inner wall portion of the ring-shaped groove 701*a*3. The fitting shaft portion 701*e* is fitted into a fitting hole portion 702*c* of the first contact terminal 702 described below. In addition, a plurality (three in the embodiment) of protrusion portions 701*f* are formed in an inner peripheral surface of an end edge portion on an opening portion side in an outer peripheral wall portion of the ring-shaped groove 701*a*3 of the first holding portion 701*a*1 in the housing 701.

Right and left extending portions 701*g* extending in a direction orthogonal to the linear groove 701*a*4 is provided in an end portion on a side opposite to the connection portion of the first holding portion 701*a*1 in the second holding portion 701*a*2 of the housing 701. An inclined portion 701*h* is formed in one of the extending portions 701*g* so that, as illustrated in FIG. 17, the first holding portion 701*a*1 is low and a portion on a side opposite to the first holding portion 701*a*1 is high.

In addition, as illustrated in FIG. 18, a rear surface protrusion portion 701*j* protruding on a rear surface side from other portions of the housing 701 is formed on the rear surface side of the right and left extending portions 701*g*. An inclined surface 701*j*1 inclined in a state where a protrusion height on a front side (first holding portion 701*a*1 side) is higher than a protrusion height on a rear side is formed in a surface of the rear surface protrusion portion 701*j*. Furthermore, a pair of right and left cylindrical positioning bosses 701*i* for positioning a mounting position of the second contact terminal 703 is provided in the inclined surface 701*j*1 of the rear surface protrusion portion 701*j*.

The first contact terminal 702 has a ring-shaped plate portion 702*a*1 and a linear plate portion 702*a*2. One end portion (inner end portion) of the linear plate portion 702*a*2 is integrally formed by being connected to a part of an outer peripheral portion of the ring-shaped plate portion 702*a*1. The ring-shaped plate portion 702*a*1 of the first contact terminal 702 is formed with a size corresponding to the ring-shaped groove 701*a*3 of the first holding portion 701*a*1 of the housing 701. The linear plate portion 702*a*2 is formed with a size corresponding to the linear groove 701*a*4 of the second holding portion 701*a*2 of the housing 701.

A conical contact portion 702*b* protruding on a rear surface side of the ring-shaped plate portion 702*a*1 is formed in the vicinity of the connection portion of the linear plate portion 702*a*2 in the ring-shaped plate portion 702*a*1. The contact portion 702*b* is arranged in a position corresponding to the through-hole portion 701*c*2 of the housing 701.

Then, the first contact terminal 702 is assembled to the housing 701 in a state where the ring-shaped plate portion 702*a*1 is inserted into the ring-shaped groove 701*a*3 of the housing 701 and the linear plate portion 702*a*2 is inserted into the linear groove 701*a*4 respectively. In this case, the fitting shaft portion 701*e* of the housing 701 is fitted into the fitting hole portion 702*c* of the ring-shaped plate portion 702*a*1 of the first contact terminal 702. Furthermore, a reference flat portion 702*g* in contact with the reference flat portion 701*d* of the housing 701 is formed by the rear surface of the ring-shaped plate portion 702*a*1 and the rear surface of the linear plate portion 702*a*2.

In addition, three notches 702*d* respectively corresponding to three protrusion portions 701*f* of the ring-shaped groove 701*a*3 are formed in an outer peripheral portion in the ring-shaped plate portion 702*a*1. Here, as illustrated in FIG. 19, three notches 702*d* are formed so that positions thereof match positions (phases) of three protrusion portions 701*f* in a state before the housing 701 and the first contact terminal 702 are correctly assembled. That is, the ring-shaped plate portion 702*a*1 is fitted into the ring-shaped groove 701*a*3 of the housing 701 in a state where three notches 702*d* of the ring-shaped plate portion 702*a*1 and three protrusion portions 701*f* of the housing 701 are positioned and the phases thereof are matched with each other. The linear plate portion 702*a*2 is set to a state (state of being rotated by a certain angle) of not being fitted into the linear groove 701*a*4 of the housing 701. Then, the first contact terminal 702 is rotated from the position of FIG. 19 in the counterclockwise direction in FIG. 19. During the rotation operation, the linear plate portion 702*a*2 of the first contact terminal 702 is elastically deformed and then is fitted into the linear groove 701*a*4 of the housing 701 over the inclined portion 701*h*. In this case, peripheral portions of the three notches 702*d* of the ring-shaped plate portion 702*a*1 are pressed below the three protrusion portions 701*f* and are elastically deformed so as to be fitted. Therefore, the three notches 702*d* are set to normal assembly positions illustrated in FIGS. 14, 15A, and the like. In a state of setting in the normal assembly positions, assembling is performed in a temporarily stopped state in which the housing 701 and the first contact terminal 702 are integrated. Thus, it is possible to prevent the housing 701 and the first contact terminal 702 from being separated from each other before the home switch 700 is incorporated into the mounting unit 705 of the first pressure adjusting chamber 261. In this case, the protrusion-shaped contact portion 702*b* of the first contact terminal 702 is exposed below the housing 701 from the through-hole portion 701*c*2 of the opening portion 701*c* of the housing 701.

In addition, when the first contact terminal 702 is rotated in a clockwise direction in FIGS. 15A to 15C from the normal assembly position illustrated in FIGS. 14, 15A, and the like, and the linear plate portion 702*a*2 is inclined at a constant angle, as illustrated in FIG. 19, three notches 702*d* of the ring-shaped plate portion 702*a*1 and three protrusion portions 701*f* of the housing 701 are positioned and the first contact terminal 702 can be removed from the housing 701 that is positioned.

Furthermore, a plurality (four in the embodiment) of tongue-shaped protrusion portions 702*f* that are a spring force generating portion are formed on a surface side of the ring-shaped plate portion 702*a*1. The protrusion portions 702*f* form substantially U-shaped notches 702*f*1 in the ring-shaped plate portion 702*a*1 and are formed so that inner portions of the notches 702*f*1 are erected upward.

One tongue-shaped protrusion portion 702*f* that is the spring force generating portion is formed in the linear plate portion 702*a*2. The protrusion portions 702*f* form substantially U-shaped notches 702*f*1 in the linear plate portion 702*a*2 and are formed so that inner portions of the notches 702*f*1 are erected upward. A bending portion 702*h*1 that is obliquely bent is formed in a distal end portion of the linear plate portion 702*a*2. A lead wire connecting hole 702*h*2 is provided in the bending portion 702*h*1. As illustrated in FIG. 14, a lead wire 711 is connected to the lead wire connecting hole 702*h*2. The lead wire 711 is fixed to the first contact terminal 702 by solder 712 after passing through the lead wire connecting hole 702*h*2.

The second contact terminal 703 has a substantially T-shaped contact plate 703*a*. A long-plate-shaped fixing portion 703*a*1 arranged in a position corresponding to the rear surface protrusion portion 701*j* of the housing 701 is formed in a proximal end of the contact plate 703*a*. A circular hole portion 703*b*, an elongated hole portion 703*c*, and a lead wire connecting hole 703*d* for positioning are formed in the fixing portion 703*a*1. The circular hole portion 703*b* and the elongated hole portion 703*c* for positioning are arranged in positions corresponding to two positioning bosses 701*i* of the housing 701. As illustrated in FIG. 14, the lead wire 711 is connected to the lead wire connecting hole 703*d* of the second contact terminal 703. The lead wire 711 is fixed to the second contact terminal 703 by solder 712 after passing through the lead wire connecting hole 703*d*.

A wide portion 703*e* is formed in a distal end of the contact plate 703*a*. The wide portion 703*e* is arranged in a position corresponding to the linear through-hole portion 701*c*1 of the opening portion 701*c* of the housing 701. Here, as illustrated in FIG. 15C, the through-hole portion 701*c*1 is formed greater than the wide portion 703*e*. Therefore, when the second contact terminal 703 is elastically deformed while the home switch 700 operates, the wide portion 703*e* is inserted into the through-hole portion 701*c*1, whereby a relief portion for preventing the wide portion 703*e* from interfering with a wall surface of the housing 701 is formed. The first contact terminal 702 and the second contact terminal 703 may be made from a material that is obtained by nickel plating on stainless steel plate or on phosphorus bronze plate, for spring to reduce an electric resistance.

The cap member 704 includes block-shaped fixing portion 704*a* arranged in a position corresponding to the rear surface protrusion portion 701*j* of the housing 701 on the rear surface side. Two positioning holes 704*b* and 704*c* are formed in the fixing portion 704*a*. The two positioning holes 704*b* and 704*c* are arranged in positions corresponding to the two positioning bosses 701*i* of the housing 701.

Then, when the second contact terminal 703 is fixed to the housing 701, the two positioning bosses 701*i* of the rear surface protrusion portion 701*j* of the housing 701 are inserted into the circular hole portion 703*b* and the elongated hole portion 703*c* for positioning of the second contact terminal 703. Subsequently, the two positioning bosses 701*i* are inserted into the two positioning holes 704*b* and 704*c* of the cap member 704, and are bonded to be fixed in place. Therefore, the fixing portion 703*a*1 of a proximal end of the contact plate 703*a* is fixed to the inclined surface 701*j*1 of the rear surface protrusion portion 701*j* of the housing 701. In this case, the inclined surface 701*j*1 of the rear surface protrusion portion 701*j* is inclined in a state in which a protrusion height on a front side (first holding portion 701*a*1 side) is higher than a protrusion height on a rear side. Therefore, in an initial state of the home switch 700, as illustrated in FIGS. 16 and 20, the second contact terminal 703 is set to be an angle not coming into contact with the protrusion-shaped contact portion 702*b* of the first contact terminal 702.

FIG. 11 is a view illustrating a state in which the home switch 700 is incorporated into the pressure adjusting unit 5. The home switch 700 is mounted in a state in which the fitting shaft portion 701*a* of the ring-shaped first holding portion 701*a*1 of the housing 701 is fitted into the recessed portion 705*a* of the end edge portion on the bonding end portion side with the pulse motor 254 in the cylinder 250. In this case, a position of the housing 701 in the height direction is regulated by the recessed portion 705*a* of the cylinder 250. Furthermore, the reference flat portion 701*d* of the housing 701 comes into contact with the reference flat portion 702*g* of the first contact terminal 702, whereby the position of the first contact terminal 702 in the height direction is determined.

The plurality of tongue-shaped protrusion portions 702*f* that are the spring force generating portions are provided in the first contact terminal 702. In a state in which the home switch 700 is incorporated into the pressure adjusting unit 5, the home switch 700 is interposed between the reference flat portion 701*d* of the housing 701 and a flat portion 709 of the pulse motor 254, whereby the plurality of tongue-shaped protrusion portions 702*f* are elastically deformed. In this case, a pressing force is operated between the flat portion 701*d* of the housing 701 and the flat portion 702*g* of the first contact terminal 702. Therefore, even after the second contact terminal 703 is elastically deformed and comes into contact with the protrusion-shaped contact portion 702*b* of the first contact terminal 702, it is possible to return to an original position and to perform positioning with high accuracy.

Moreover, the first contact terminal 702 is made of a conductive material and when the flat portion 709 of the pulse motor 254 contacts a ground of a conductor, it cannot be correctly sensed. Thus, a portion between the flat portion 709 of the pulse motor 254 and the first contact terminal 702 is insulated by interposing an insulating sheet 708 therebetween.

As illustrated in FIG. 11, flat surfaces 710 are respectively provided in top surfaces of two pistons (piston 252 and piston 253) of the pressure adjusting unit 5. The pistons 252 and 253 are vertically moved in FIG. 11 by driving the pulse motors 254 and 255. Then, the second contact terminal 703 comes into contact with the flat surfaces 710 of each of the pistons 252 and 253, whereby the second contact terminal 703 is elastically deformed and comes into contact with the protrusion-shaped contact portion 702*b* of the first contact terminal 702 so that the terminal 703 serves as a mechanical switch. In this case, an original point position x0 of the rotation shaft 254*a* of the pulse motor 254 in the axial direction and an original point position y0 of a rotation shaft 255*a* of the pulse motor 255 in the axial direction are detected.

FIG. 20 illustrates a partial sectional view before the home switch 700 is operated, and FIG. 21 illustrates a partial sectional view after the home switch 700 is operated. FIG. 22 illustrates a schematic diagram of the home switch 700. In FIG. 22, a solid line indicates a state before the home switch 700 is operated. In this state, the second contact terminal 703 is held in a non-contact state in which the second contact terminal 703 does not abut against the protrusion-shaped contact portion 702*b* of the first contact terminal 702. In this case, current flows on a control input port 721 side.

In FIG. 22, a dotted line indicates a state in which the second contact terminal 703 abuts against the protrusion-shaped contact portion 702*b* of the first contact terminal 702. In this state, since it is possible to connect to the ground through the home switch 700, the current does not flow on the control input port 721 side.

Next, an operation of the pressure adjusting unit 5 will be described with reference to FIG. 13. The original point position of the rotation shaft 254*a* of the pulse motor 254 in the axial direction is indicated by x0, and the original point position of the rotation shaft 255*a* of the pulse motor 255 in the axial direction is indicated by y0. The home positions of the piston 252 and the piston 253 are x1 and y1. The home position x1 is set in a position in which the piston 253 does not abut against a distal end 306 of the opening and closing member 259 and the communication tube 258 is in the closed state. In addition, the home position y1 is set in a position in which the piston 252 does not press a distal end 305 of the opening and closing member 257 and the communication duct 256 is in the closed state.

A position x2 is a position in which the piston 253 presses the distal end 306 of the opening and closing member 259 and the opening and closing member 259 is opened. A distance from x1 to x2 is formed by a stroke h1 and the distance is set so that the piston 253 abuts against the opening and closing member 259 and then presses the opening and closing member 259.

When the piston 252 is in the home position y1, a position moved by h2 upward in the direction H is y1' to keep a sum of volumes of the third gas chamber 272 and the fourth gas chamber 270 to be constant. A volume V1 obtained by moving the piston 253 by the stroke h1 and a volume V2 obtained by moving the piston 252 by the stroke h2 are set to be equal. When cross-sectional areas of the cylinder 251 and the cylinder 250 are equal, the relationship h1=h2 is satisfied.

A position y2' is an upper limit position to which the piston 252 is moved by performing pressure adjustment. When the position of the piston 252 is in the upper limit y2', a position moved by h2 downward in the direction H is y2 to keep a sum of volumes of the third gas chamber 272 and the fourth gas chamber 270 to be constant.

A position y3' is a lower limit position to which the piston 252 is moved by performing pressure adjustment. When the position of the piston 252 is in the lower limit position y3', a position moved by h2 downward in the direction H is y3 to keep a sum of volumes of the third gas chamber 272 and the fourth gas chamber 270 to be constant. When the piston 252 is in y3, a distance is set so as not to abut against a distal end 307 of the opening and closing member 401. A position y4 is a position in which the piston 252 opens the opening and closing member 401 and a position y5 is a position in which the piston 252 opens the opening and closing member 257.

A procedure when the first gas chamber 350 is opened to the atmosphere is illustrated. First, when the piston 253 is in the position x2 to open the opening and closing member 259, it is in the state of the position x1 to open the opening and closing member 259 and pressure fluctuation of the pressure adjusting unit 5 does not reach the first gas chamber 350 respectively.

Next, the piston 252 is moved to the position y4 and the opening and closing member 401 is opened. In this case, the volume of the fourth gas chamber 270 is compressed and a pressure within the fourth gas chamber 270 and the third gas chamber 272 communicating therewith is increased, but the opening and closing member 259 is closed, whereby the pressure fluctuation does not reach the first gas chamber 350. When the piston 252 opens the opening and closing member 401, the pressure within the fourth gas chamber 270 and the third gas chamber 272 communicating therewith becomes the atmospheric pressure.

Next, the opening and closing member 259 is opened and the piston 253 is moved to the position x2. In this case, the volume of the third gas chamber 272 is compressed until coming into contact with the distal end 306 of the opening and closing member 259. Since the opening and closing member 401 is opened and is opened to the atmosphere, the pressure remains at the atmospheric pressure. When the piston 253 is moved to the position x2 to come into contact with and press the distal end 306 of the opening and closing member 259, the first gas chamber 350 becomes opened to the atmosphere via the third gas chamber 272 and the fourth gas chamber 270 communicating therewith.

A procedure that the second gas chamber 360 is opened to the atmosphere is illustrated. When the piston 253 is in the position x2 to open the opening and closing member 259, as illustrated respectively, it is in the state of the position x1 to close the opening and closing member 259 and pressure fluctuation of the pressure adjusting unit 5 does not reach the first gas chamber 350.

Next, the opening and closing member 257 is pressed and the piston 252 is moved to the position y5. In this case, the volume of the fourth gas chamber 270 is compressed until coming into contact with the distal end 307 of the opening and closing member 401 and the pressure within the fourth gas chamber 270 and the third gas chamber 272 communicating therewith is increased. However, since the opening and closing member 259 is closed, the pressure fluctuation does not reach the first gas chamber 350.

When the opening and closing member 401 is opened by being pressed by the piston 252, the pressure within the fourth gas chamber 270 and the third gas chamber 272 communicating therewith becomes the atmospheric pressure. In this case, first, when a positional relationship is achieved so that the distal end 305 of the opening and closing member 257 is pressed and then the distal end 307 of the opening and closing member 401 is pressed, compressed air flows into the second gas chamber 360 and the pressure fluctuation is exerted. Thus, a distance G is set so that the piston 252 abuts against the distal end 307 of the opening and closing member 401 and then abuts against the distal end 305 of the opening and closing member 257.

When the piston 252 is moved to the position y5 to abut and press the distal end 305 of the opening and closing member 257, the second gas chamber 360 is in the opened state to the atmosphere via the fourth gas chamber 270. Since the opening and closing member 259 is closed, the first gas chamber 350 is not opened to the atmosphere.

A procedure that the first gas chamber 350 and the second gas chamber 360 are opened to the atmosphere is illustrated. The piston 253 is moved to the position x2 to press and open the opening and closing member 259 in a state in which the second gas chamber 360 is opened to the atmosphere. In this case, the volume of the third gas chamber 272 is compressed until coming into contact with the distal end 306 of the opening and closing member 259. Since the opening and closing member 401 is opened and is in the opened state to the atmosphere, the pressure remains at the atmospheric pressure. When the piston 253 is moved to the position x2 to press and open the distal end 306 of the opening and closing member 259, the first gas chamber 350 becomes the opened state to the atmosphere via the third gas chamber 272 and the fourth gas chamber 270 communicating therewith. The second gas chamber 360 also becomes the opened state to the atmosphere via the fourth gas chamber 270.

Next, a procedure that the opening and closing member 401 is closed from the position y4 in which the piston 252 opens the opening and closing member 401 and the piston 252 is returned to the home position y1.

In a state in which the first gas chamber 350 is opened to the atmosphere, the position of the piston 253 is moved to the position x1 while the position of the piston 252 is the position y4.

In a state in which the second gas chamber 360 is opened to the atmosphere, the position of the piston 252 is moved to the position y4.

In a state in which the first gas chamber 350 the second gas chamber 360 are opened to the atmosphere, after the position of the piston 253 is moved to the position x1, the position of the piston 252 is moved to the position y4. Thereafter, when the piston 252 is moved to the position y6 in contact with the distal end 307 of the opening and closing member 401, the opening and closing member 401 is closed.

When the opening and closing member 401 is closed, the fourth gas chamber 270 and the third gas chamber 272 communicating therewith are in a sealed state. Thus, the fourth gas chamber 270 and the third gas chamber 272 communicating therewith are decompressed by a volume V3 that is obtained by a stroke h3 moving from y6 to y1 that is the home position. Therefore, as it is, when the position of the piston 253 is moved from the position x1 to the position x2, since the decompressed air is supplied to the first gas chamber 350, sudden pressure fluctuation may be exerted. In order to avoid the sudden pressure fluctuation, when the piston 252 is in the position y4, that is, the fourth gas chamber 270 and the third gas chamber 272 communicating therewith are opened to the atmosphere; the position of the piston 253 is moved by a distance h4 from the position x1 to the position x3.

Thereafter, the position of the piston 252 is moved from the position y4 to the position y1 through the position y6. In this case, the fourth gas chamber 270 and the third gas chamber 272 communicating therewith are decompressed by the volume V3 that is obtained by the distance h3 moving from the position y6 to the position y1.

Thereafter, the position of the piston 253 is moved from the position x3 to the position x1. In this case, the fourth gas chamber 270 and the third gas chamber 272 communicating therewith are pressurized by the volume V4 that is obtained by the moving distance h4 moving from the position x3 to the position x1.

When V3=V4, a sum of volumes of the fourth gas chamber 270 and the third gas chamber 272 communicating therewith are the same when the piston 253 is positioned in the position x3 and the piston 252 is positioned in the position y6, and when the piston 253 is positioned in the position x1 and the piston 252 is positioned in the position y1.

When the piston 252 is in the position y6, that is, when the opening and closing member 401 is closed, the pressure of the fourth gas chamber 270 and the third gas chamber 272 communicating therewith are the same is the atmosphere. Thus, even when the piston 253 and the piston 252 are respectively positioned in the position x1 and the position y1, the pressure thereof is the atmosphere.

When V3>V4, the sum of volumes of the fourth gas chamber 270 and the third gas chamber 272 communicating therewith are greater when the piston 253 is positioned in the position x1 and the piston 252 is positioned in the position y1 than when the piston 253 is positioned in the position x3 and the piston 252 is positioned in the position y6. That is, the pressure is reduced by a volume of (V3−V4). The pressure of the first gas chamber 350 is equal to the pressure before opening to the atmosphere by adjusting the volume and then it is possible to restart the pressure adjustment.

When V3<V4, the sum of volumes of the fourth gas chamber 270 and the third gas chamber 272 communicating therewith is less when the piston 253 is positioned in the position x1 and the piston 252 is positioned in the position y1 than when the piston 253 is positioned in the position x3 and the piston 252 is positioned in the position y6. That is, the pressure is reduced by a volume of (V4−V3).

In a case in which the position of the piston 252 reaches the uppermost position y2' and the lowermost position y3' to which the piston 252 is moved by performing the pressure adjustment, the piston 252 cannot be moved due to the pressure adjustment.

However, even when the piston 252 is in the position y2' and the position y3', it is possible to move the piston 253 from the position x2 to the position x1 so as not to be subjected to the pressure fluctuation of the first gas chamber. Therefore, first, the piston 253 is moved from the position x2 to the position x1 and the piston 252 is moved from the position y2' to the position y2 and is moved from the position y3' to the position y3, and the piston 252 is moved to the position y4 from this state, the opening and closing member 401 is opened, and is opened to the atmosphere. Thereafter, a procedure, in which the opening and closing member 401 is closed from the position y4 in which the piston 252 presses and opens the opening and closing member 401, and the piston 252 is returned to the home position y1, is performed, whereby it is possible to return the piston 252 to the position y1 in a state of the pressure before performing the pressure adjustment.

Figure 23:
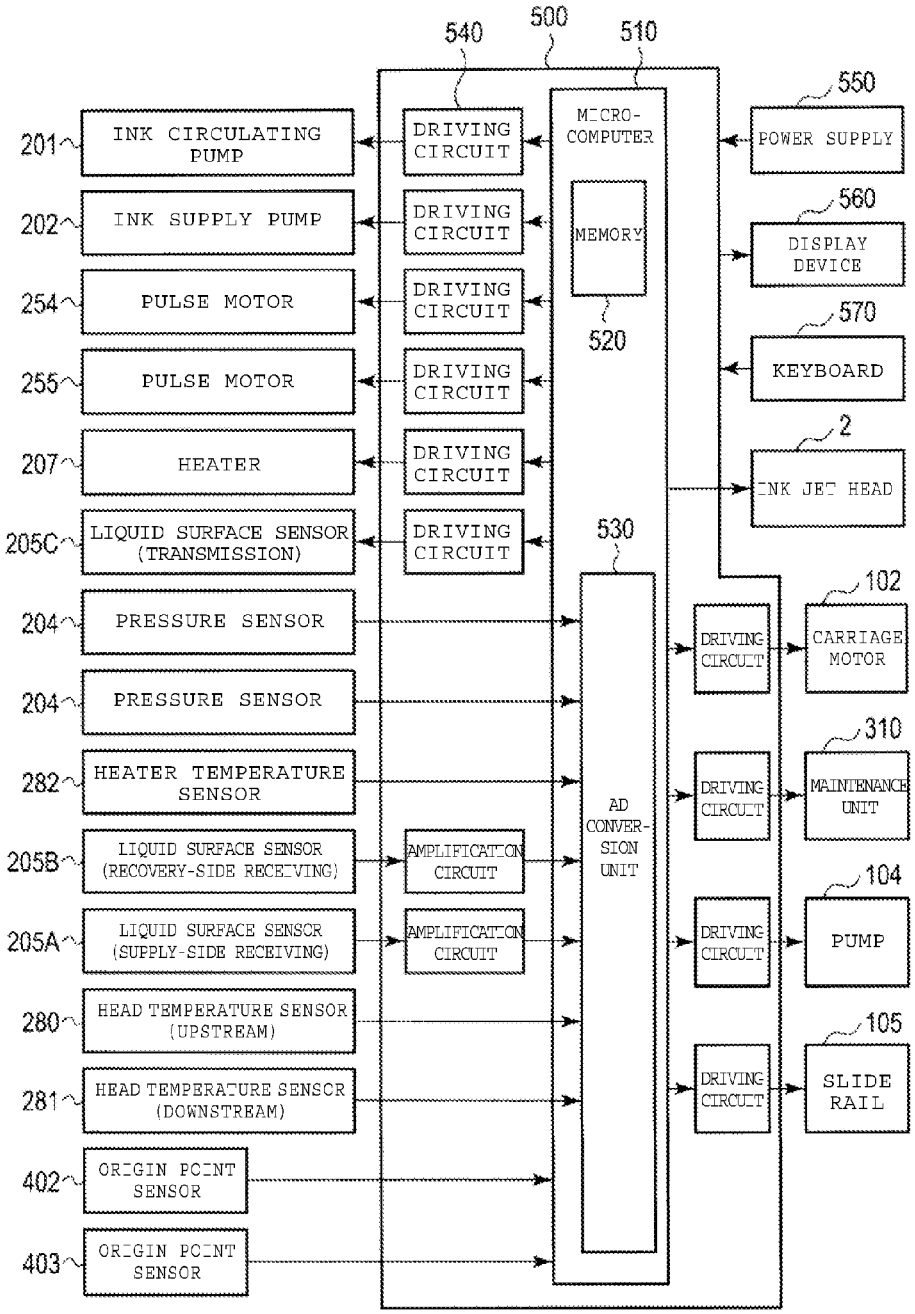
FIG. 23 is a schematic configuration of a control substrate of the ink jet printing apparatus according to the first embodiment.

FIG. 23 is a block diagram of the control substrate 500 that controls an operation of the ink jet printing apparatus 1. A power supply 550, a display device 560 that display a situation of the ink jet printing apparatus 1, and a keyboard 570 are connected to the control substrate 500. The control substrate 500 includes a microcomputer 510 that is a control unit that controls the operation, a memory 520 that stores programs, an AD conversion unit 530 that receives an output voltage of the pressure sensor 204 or the temperature sensors 280, 281, and 282. Furthermore, the control substrate 500 includes a driving circuit 540 and operates the ink jet printing unit 4, the carriage motor 102 that relatively moves the ink jet printing unit 4 with respect to the recording medium S, the pulse motors 254 and 255 that operates the pistons 252 and 253, the slide rail 105, the pumps 104, 201, and 202, the heater 207, and the like.

Printing Operation

A printing operation of the ink jet printing apparatus 1 will be described. When the inkjet printing apparatus 1 initially performs the printing operation, the ink circulating device 3 and the ink jet head 2 are filled with ink from the ink cartridge 81. When an initial filling operation is instructed from the keyboard, the microcomputer 510 causes the ink jet printing unit 4 to return to the standby position, the maintenance unit 310 to increase, and the nozzle plate 52 to be covered.

The microcomputer 510 controls the pressure adjusting unit 5 and as illustrated in FIG. 13, causes the pistons 252 and 253 to be positioned in the home positions x1 and y1. Ink is fed from the ink cartridge 81 to the recovery-side ink chamber 211 of the ink casing 200 together with air within the tube 82 by driving the ink supply pump 202. In this case, since the flow path resistance on the inside of the ink jet head 2 is great, ink does not flow into the ink jet head 2 and the supply-side ink chamber 210 in a short period of time.

When the ink amount measuring sensor 205B of the recovery-side ink chamber 211 detects that ink flows into the suction hole 212, the microcomputer 510 starts adjustment of the pressure within the ink casing 200 and drives the ink circulating pump 201 by controlling the pressure adjusting unit 5. Ink is fed from the recovery-side ink chamber 211 to the supply-side ink chamber 210 through the ink circulating pump 201. When liquid amount detection results of the recovery-side ink chamber 211 and the supply-side ink chamber 210 by the ink amount measuring sensors 205A and 205B respectively reach the suction hole 212 and the discharge hole 213 of the circulating pump 201, filling of ink is completed. When the ink amount of the recovery-side ink chamber 211 is insufficient, ink is fed from the ink cartridge 81 to the recovery-side ink chamber 211 of the ink casing 200 by driving the ink supply pump 202.

The ink amount of the recovery-side ink chamber 211 and the supply-side ink chamber 210 becomes proper by repeating the operation and the initial filling operation is completed. Moreover, since the pressure adjusting unit 5 is operated and the ink casing 200 is in a sealed state, the pressure of the meniscus 290 of the nozzle 51 is maintained in the negative pressure and ink is not leaked even when power supply is turned off.

Moreover, the pressure sensor 204 outputs a pressure as a voltage. When the pressure sensor 204 is used for a long period of time or environment (temperature) conditions are changed, differences in the pressure and the output voltage occur. Then, it is possible to accurately detect the pressure by saving an output voltage valve of the atmospheric pressure to memory 520 and determining a pressure (gauge pressure) by a difference with the output voltage valve during detection of the pressure. When it is a time to save the output voltage valve of the atmospheric pressure to memory 520, the pressure adjusting chambers 261 and 262 communicate with the atmosphere. Since the pressure of the recovery-side ink chamber 211 becomes the atmosphere, the output voltage valve at this time is stored in the memory 520 of the control substrate 500. When the pressure within the ink casing 200 becomes the atmospheric pressure, the meniscus of the nozzle 51 of the inkjet head 2 becomes the positive pressure and ink may be leaked from the nozzle 51. However, since an operation causing the pressure within the ink casing 200 to be the atmospheric pressure is completed in a short period of time, when the recovery-side ink chamber 211 is adjusted to a predetermined pressure after saving the output voltage valve of the atmospheric pressure, ink is not leaked from the nozzle 51. Timing for storing the output voltage valve of the atmospheric pressure into the memory 520 is a time when power supply of the apparatus is turned on. Moreover, as timing other than saving the output voltage valve of the atmospheric pressure into the memory, it is also possible to be performed for every predetermined time by a timer mounted in the apparatus. If the output voltage valve is saved in the memory 520 for every predetermined time, when the timing occurs during printing in the ink jet printing unit 4, the printing operation may be stopped. In order not to stop the printing operation, printing is completed by shifting the timing for saving the output voltage valve of the atmospheric pressure even when a predetermined time is elapsed in the timer, and then the output voltage valve is saved in the memory 520.

When printing is started, the microcomputer 510 controls the maintenance unit 310 and separates the maintenance unit 310 from the nozzle plate 52. The microcomputer 510 controls the pressure adjusting unit 5, positions the piston 253 to the position x2 and the piston 252 to the position y1', and adjusts the pressure within the recovery-side ink chamber 211. The microcomputer 510 drives the ink circulating pump 201 and circulates ink from the recovery-side ink chamber 211 to the ink circulating pump 201, the supply-side ink chamber 210, the ink jet head 2, and the recovery-side ink chamber 211 in this order. When the height of the ink liquid surface a detected by the ink amount measuring sensors 205A and 205B of the supply-side ink chamber 210 and the recovery-side ink chamber 211 is not a desired ink liquid surface height, the microcomputer 510 drives the ink supply pump 202 and supplies ink from the ink cartridge 81 to the recovery-side ink chamber 211 until the height becomes the desired ink liquid surface height. The microcomputer 510 energizes the heater 207 mounted in the ink casing 200 and performs heating until ink has a desired temperature. When ink has the desired temperature, energization of the heater is controlled so that the ink temperature falls within a predetermined range.

Next, the microcomputer 510 controls the ink jet head 2 and ejects ink onto the recording medium S according to the image data printing based on, for example, the scanning of the carriage 100. The microcomputer 510 controls the recording medium moving unit 7, moves the recording medium S at a predetermined distance in the slide rail 105, repeats the ejecting operation of ink in synchronization with scanning of the carriage 100, and forms an image on the recording medium S. When ink is ejected from the ink jet head 2, the ink amount within the ink casing 200 is momentarily decreased and the pressure within the recovery-side ink chamber 211 is lowered. When the pressure sensor 204 detects that the pressure within the recovery-side ink chamber 211 is lowered, the microcomputer 510 controls the pressure adjusting unit 5, positions the piston 253 to the position X2 and the piston 252 to the position Y1', adjusts the pressure within the recovery-side ink chamber 211, and feeds ink corresponding to the ink amount ejected by driving the ink supply pump 202 to the recovery-side ink chamber 211.

Here, since a volume of the ink droplets ejected from the ink jet head 2 is constant and the number of the ink droplets ejected from the image data can be also calculated, a using amount of ink may be calculated by a product thereof. Therefore, the ink amount within the ink casing 200 during the printing operation immediately returns to a predetermined amount.

In a case in which there is no ink within the ink cartridge 81, even when the ink supply pump 202 is driven for a predetermined time, the ink liquid surface of the recovery-side ink chamber 211 is not a desired height. When the ink liquid surface of the recovery-side ink chamber 211 is not a desired height, a display indicating that the ink cartridge 81 is empty is executed by the display device 560.

Good ink ejection can be maintained by moving the piston 252 of the pressure adjusting chamber 261 communicating with the first gas chamber 350 so that the pressure of the nozzle 51 becomes a predetermined pressure.

The ink jet printing apparatus 1 forms an image while the ink jet printing units 4*a* and 4*b* are reciprocated orthogonal to the transport direction of the recording medium S. Moreover, the longitudinal direction in which the nozzles are arranged is the same as the transport direction of the recording medium S and the ink jet printing apparatus 1 forms an image of the width of 300 nozzles on the recording medium S.

According to the pressure adjusting device according to the embodiment, the mounting units 705 and 706 of the home switch 700 are provided in each of two the first pressure adjusting chamber 261 and the second pressure adjusting chamber 262 of the pressure adjusting unit 5. Here, as illustrated in FIG. 10, the circular recessed portion 705*a* is formed in the end edge portion on the bonding end portion side with the pulse motor 254 in the cylinder 250 of the first pressure adjusting chamber 261 and the mounting unit 705 of the home switch 700 is formed by the recessed portion 705*a*. Similarly, also in the second pressure adjusting chamber 262, the circular recessed portion 706*a* is formed in the end edge portion on the bonding end portion side with the pulse motor 255 and the mounting unit 706 of the home switch 700 is formed by the recessed portion 706*a*. Then, it is possible to use the home switch 700 on the bonding end portion side with the pulse motors 254 and 255 that are not necessary to be sealed by mounting the home switch 700 on each of the recessed portions 705*a* and 706*a*. Thus, the lead wire 711 of the home switch 700 and the like need not be sealed particularly; it is possible to provide the space-saving home switch 700. Then, sealing of two the first pressure adjusting chamber 261 and the second pressure adjusting chamber 262 of the pressure adjusting unit 5 is not inhibited.

In addition, when using the pressure adjusting device, the pistons 252 and 253 are moved vertically in FIG. 11 by driving the pulse motors 254 and 255. Then, the second contact terminal 703 comes into contact with the flat surface 710 of each of the piston 252 and 253, whereby the second contact terminal 703 is elastically deformed. The second contact terminal 703 comes into contact with the protrusion-shaped contact portion 702*b* of the first contact terminal 702 so that the terminal 703 serves as the mechanical switch. In this case, the original point position x0 of the rotation shaft 254*a* of the pulse motor 254 in the axial direction and an original point position y0 of a rotation shaft 255*a* of the pulse motor 255 in the axial direction are detected. Therefore, it is possible to provide the pressure adjusting device in which the original point positions of the rotation shafts 254*a* and 255*a* of the pulse motors 254 and 255 can be accurately detected, positioning can be performed with high accuracy, and the space-saving home switch 700 that does not inhibit a movement amount of the pressure adjusting mechanism can be used.

Second Embodiment

Figure 24:
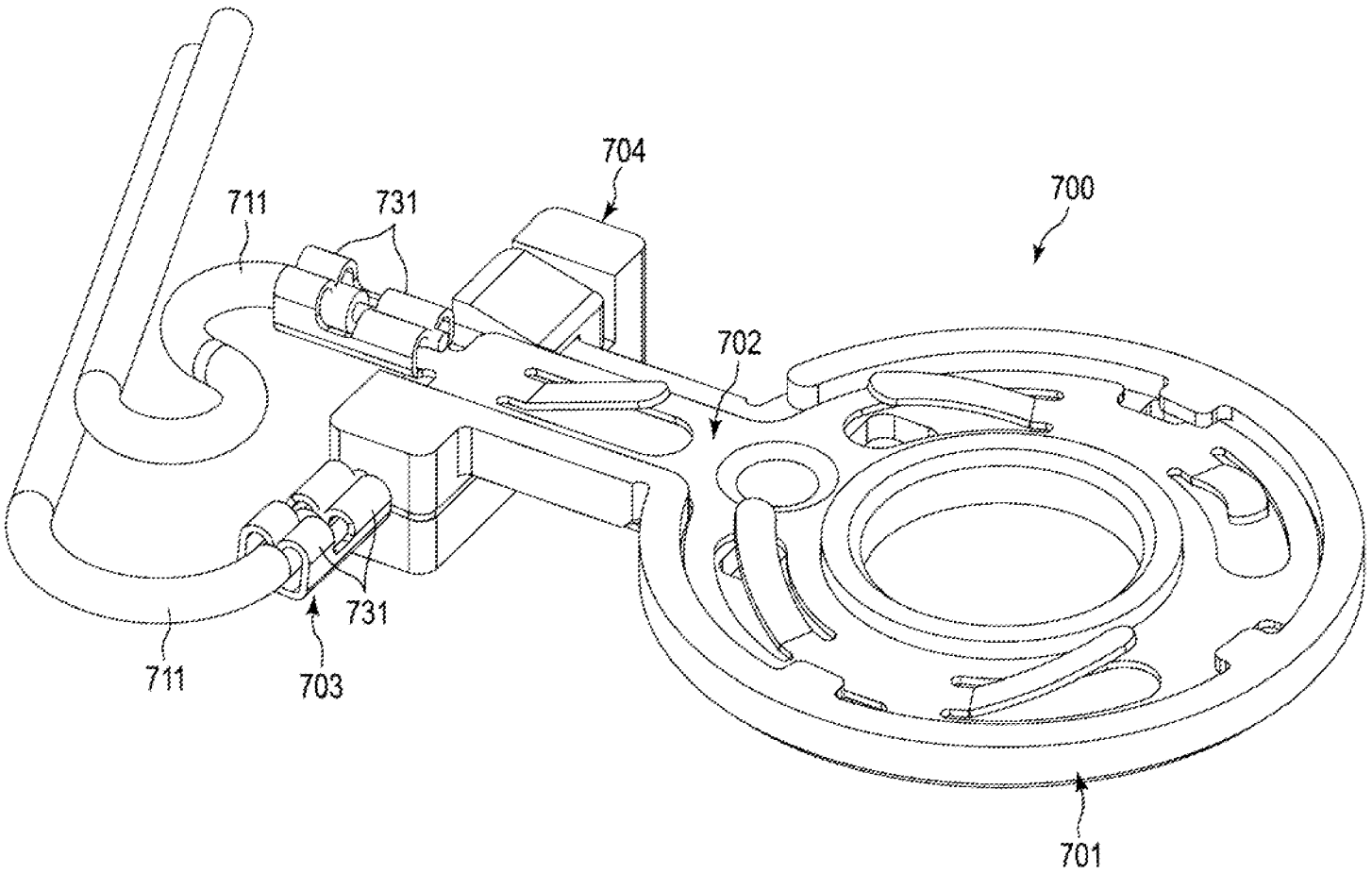
FIG. 24 is a perspective view of a modification example of a home switch.
Figure 25:
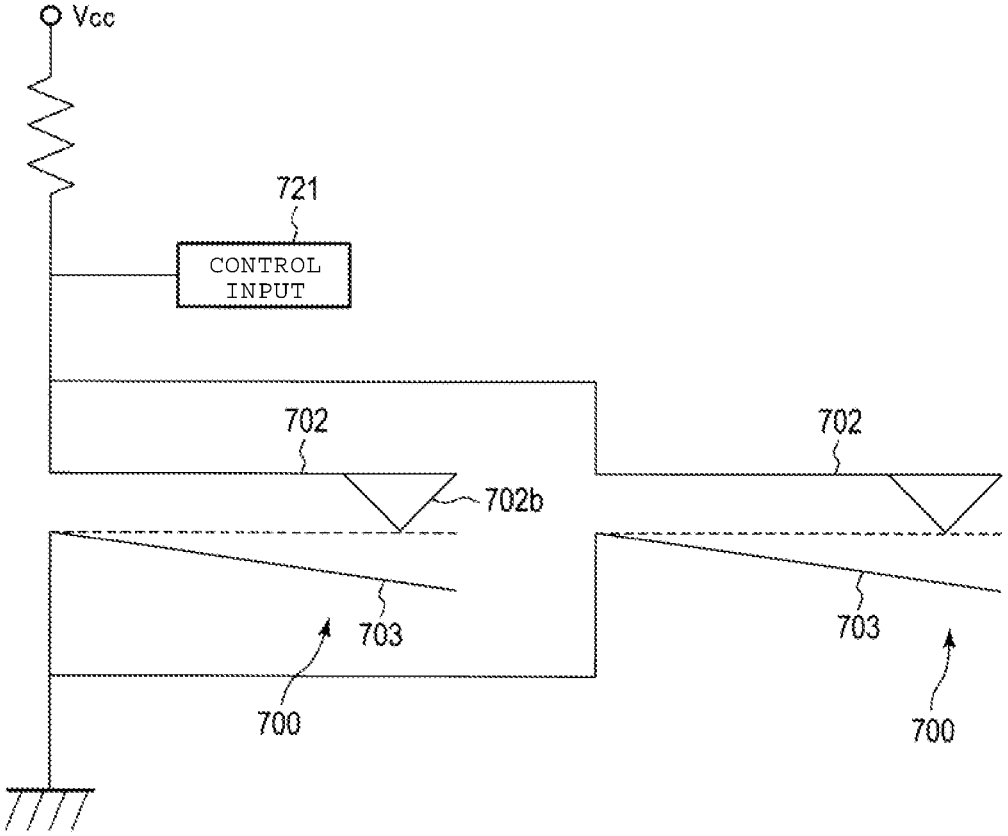
FIG. 25 is a schematic configuration of another modification example of a home switch.

FIG. 24 illustrates a second embodiment. The embodiment is a modification example in which the configuration of the home switch 700 according to the first embodiment (see FIGS. 1 to 23) is changed as follows. That is, the home switch 700 according to the embodiment is changed in the method for fixing the lead wire 711.

The method for fixing the lead wire 711 is not limited to solder 712, and as illustrated in FIG. 24, metal plates 731 may be provided in a state of being bent so as to surround a connection end portion of each lead wire 711 in the first contact terminal 702 and the second contact terminal 703.

In addition, FIG. 24 illustrates a case in which a plurality (equal to or greater than two) of home switches 700 are used to share one control input port 721. When the original point positions of the rotation shafts 254*a* and 255*a* of a plurality of pulse motors 254 and 255 are detected at the same time, the home switch 700 is respectively required. However, when the detection of the original point positions of the rotation shafts 254*a* and 255*a* of the plurality (for example, two) of pulse motors 254 and 255 is individually performed, as illustrated in FIG. 24, two home switches 700 are connected in parallel. Therefore, it is possible to individually detect the original point positions of the rotation shafts 254*a* and 255*a* of the plurality of pulse motors 254 and 255 by one control input port 721.

According to the embodiments, it is possible to provide the pressure adjusting device in which the original point position of the rotation shaft of the pulse motor can be accurately detected and the space-saving switch can be used.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A pressure adjusting device comprising:

a housing that includes a cylinder;

a piston that moves within the cylinder in an axial direction;

a pulse motor fixed to the housing and including a rotation shaft that is connected to the piston so that a rotational movement of the rotation shaft translates into a translational movement in the axial direction of the piston; and an origin point switch provided on a surface of the cylinder, the origin point switch being actuated by movement of the piston in the cylinder in the axial direction, wherein the origin point switch includes:

a first contact member that is formed of a conductor and includes a contact point at a fixed position, a positioning member that is interposed between the pulse motor and the cylinder, and has an open portion that exposes the contact point of the first contact member, and a second contact member that is formed of an elastically deformable conductor and includes a fixed end fixed to the positioning member on one end side and a movable contact point elastically held, when the piston is in an initial position, in a position separated from and facing the contact point of the first contact member, wherein the piston presses the movable contact point in a direction to abut against the contact point of the first contact member when the piston moves from a position other than the initial position to the initial position so that the movable contact point electrically contacts the contact point of the first contact member.

2. The device according to claim 1, wherein the first contact member generates an elastic force in a moving direction of the rotation shaft due to a portion of the first contact member protruding from the open portion of the positioning member and being positioned between the positioning member and the pulse motor.

3. The device according to claim 1, wherein the rotation shaft is connected to the piston by a conversion member, the conversion member including:

a female screw portion formed in a shaft of the piston, a male screw portion connected to the rotation shaft of the pulse motor and screwed into the female screw portion.

4. The device according to claim 1, further comprising:

a shaft connected to a head of the piston, and a shaft hole formed in the housing and configured to receive the shaft and prevent the shaft from rotating.

5. The device according to claim 1, wherein the positioning member includes an inclined portion that holds the movable contact point separated from the contact point of the first contact member.

6. The device according to claim 1, wherein the first contact member and the second contact member are fixed to the origin point switch by one of a soldered connection and a bent metal plate that surrounds a connecting end portion of a lead wire.

7. The device according to claim 1, wherein, when the movable contact point is not in electrical contact with the contact point of the first contact member, at least one opening and closing member positioned in the cylinder is opened to adjust a pressure in a pressure chamber adjacent to the cylinder.

8. The device according to claim 7, wherein, when the movable contact point is in electrical contact with the contact point of the first contact member, the at least one opening and closing member positioned in the cylinder is closed.

9. An inkjet printing device comprising:

an ink head having at least one nozzle for ejecting ink;

an ink circulating unit for circulating ink to and from the ink head; and a pressure adjusting unit for adjusting a pressure in the ink circulating unit, the pressure adjusting unit including: a housing that includes a cylinder, a piston that moves within the cylinder in an axial direction, a pulse motor fixed to the housing and including a rotation shaft that is connected to the piston so that a rotational movement of the rotation shaft translates into a translational movement in the axial direction of the piston, and an origin point switch provided on a surface of the cylinder, the origin point switch being actuated by movement of the piston in the cylinder in the axial direction, wherein the origin point switch includes: a first contact member that is formed of a conductor and includes a contact point at a fixed position, a positioning member that is interposed between the pulse motor and the cylinder, and has an open portion that exposes the contact point of the first contact member, and a second contact member that is formed of an elastically deformable conductor and includes a fixed end fixed to the positioning member on one end side and a movable contact point elastically held, when the piston is in an initial position, in a position separated from and facing the contact point of the first contact member, wherein the piston presses the movable contact point in a direction to abut against the contact point of the first contact member when the piston moves from a position other than the initial position to the initial position so that the movable contact point electrically contacts the contact point of the first contact member.

10. The device according to claim 9, wherein the first contact member generates an elastic force in a moving direction of the rotation shaft due to a portion of the first contact member protruding from the open portion of the positioning member and being positioned between the positioning member and the pulse motor.

11. The device according to claim 9, wherein the rotation shaft is connected to the piston by a conversion member, the conversion member including:

a female screw portion formed in a shaft of the piston, a male screw portion connected to the rotation shaft of the pulse motor and screwed into the female screw portion.

12. The device according to claim 9, further comprising:

a shaft connected to a head of the piston, and a shaft hole formed in the housing and configured and shaped to receive the shaft and prevent the shaft from rotating.

13. The device according to claim 9, wherein the positioning member includes an inclined portion that holds the movable contact point separated from the contact point of the first contact member.

14. The device according to claim 9, wherein the first contact member and the second contact member are fixed to the origin point switch by one of a soldered connection and a bent metal plate that surrounds a connecting end portion of a lead wire.

15. The device according to claim 9, wherein, when the movable contact point is not in electrical contact with the contact point of the first contact member, at least one opening and closing member positioned in the cylinder is opened to adjust a pressure in a pressure chamber adjacent to the cylinder.

16. The device according to claim 9, wherein, when the movable contact point is in electrical contact with the contact point of the first contact member, the at least one opening and closing member positioned in the cylinder is closed.

* * * * *